US011796277B2

(12) United States Patent
McPherson

(10) Patent No.: US 11,796,277 B2
(45) Date of Patent: Oct. 24, 2023

(54) ARCHERY BOW WITH PASS THROUGH CABLING

(71) Applicant: MCP IP, LLC, Sparta, WI (US)

(72) Inventor: Mathew A. McPherson, Norwalk, WI (US)

(73) Assignee: MCP IP, LLC, Sparta, WI (US)

( * ) Notice: Subject to any disclaimer, the term of this patent is extended or adjusted under 35 U.S.C. 154(b) by 0 days.

(21) Appl. No.: 16/990,874

(22) Filed: Aug. 11, 2020

(65) Prior Publication Data

US 2020/0378713 A1 Dec. 3, 2020

Related U.S. Application Data

(63) Continuation of application No. 16/546,051, filed on Aug. 20, 2019, now Pat. No. 10,739,103, which is a continuation of application No. 15/892,309, filed on Feb. 8, 2018, now Pat. No. 10,386,151.

(60) Provisional application No. 62/457,100, filed on Feb. 9, 2017.

(51) Int. Cl.
*F41B 5/12* (2006.01)
*F41B 5/10* (2006.01)

(52) U.S. Cl.
CPC ..... *F41B 5/105* (2013.01); *F41B 5/10* (2013.01); *F41B 5/123* (2013.01)

(58) Field of Classification Search
CPC .. F41B 5/10; F41B 5/105; F41B 5/123; F41B 5/12; Y10S 124/90
USPC ..... 124/25.6, 900, 25
See application file for complete search history.

(56) References Cited

U.S. PATENT DOCUMENTS 3,851,638 A * 12/1974 Alexander ..... F41B 5/105 124/90
3,958,551 A * 5/1976 Ketchum ..... F41B 5/10 124/90
4,060,066 A * 11/1977 Kudlacek ..... F41B 5/10 124/90
4,241,715 A * 12/1980 Jennings ..... F41B 5/10 124/25.6
4,300,521 A * 11/1981 Schmitt ..... F41B 5/105 124/900
4,333,443 A * 6/1982 Roelle ..... F41B 5/10 124/90

(Continued)

OTHER PUBLICATIONS

Browning Archery 1997 Product Catalog, Browning Archery, Inc., Morgan, UT (published 1997).

(Continued)

*Primary Examiner* — Alexander R Niconovich
(74) *Attorney, Agent, or Firm* — Laabs Intellectual Property

(57) ABSTRACT

In some embodiments, a bow comprises a first limb supporting a first rotatable member. The first rotatable member comprises a first bowstring track and a first terminal post. A second limb supports a second rotatable member. The second rotatable member comprising a second bowstring track and a second terminal post. A bowstring comprises a first end attached to the first terminal post and a second end attached to the second terminal post. The first bowstring track and the second bowstring track are oriented in a bowstring plane, and the first terminal post is laterally offset from the bowstring plane.

14 Claims, 30 Drawing Sheets

(56) References Cited

U.S. PATENT DOCUMENTS 4,338,910 A * 7/1982 Darlington ..... F41B 5/10 124/900
4,401,097 A * 8/1983 Simonds ..... F41B 5/105 124/900
4,457,288 A * 7/1984 Ricord ..... F41B 5/10 124/900
4,461,267 A * 7/1984 Simonds ..... F41B 5/105 124/900
4,478,203 A * 10/1984 Hayes ..... F41B 5/10 124/88
4,515,142 A * 5/1985 Nurney ..... F41B 5/10 124/900
4,561,413 A * 12/1985 Jennings ..... F41B 5/105 124/25.6
4,562,824 A * 1/1986 Jennings ..... F41B 5/105 124/25.6
4,686,955 A * 8/1987 Larson ..... F41B 5/10 124/900
4,748,962 A * 6/1988 Larson ..... F41B 5/105 124/900
4,756,296 A * 7/1988 Darlington ..... F41B 5/105 124/900
4,770,154 A * 9/1988 Cook ..... F41B 5/105 124/900
4,774,927 A * 10/1988 Larson ..... F41B 5/105 124/900
4,838,236 A * 6/1989 Kudlacek ..... F41B 5/105 124/900
4,926,832 A * 5/1990 Darlington ..... F41B 5/10 124/90
4,967,721 A * 11/1990 Larson ..... F41B 5/10 124/900
4,986,250 A * 1/1991 Darlington ..... F41B 5/105 124/90
4,995,373 A * 2/1991 Mussack ..... F41B 5/10 124/900
5,211,155 A * 5/1993 Zamojski ..... F41B 5/10 124/900
5,368,006 A * 11/1994 McPherson ..... F41B 5/10 124/900
5,495,843 A * 3/1996 Larson ..... F41B 5/10 124/900
5,687,703 A * 11/1997 Vyprachticky ..... F41B 5/10 124/900
5,782,229 A * 7/1998 Evans ..... F41B 5/10 124/900
5,791,322 A * 8/1998 McPherson ..... F41B 5/105 124/900
5,791,323 A * 8/1998 Dunlap ..... F41B 5/10 124/900
5,881,705 A * 3/1999 Howell ..... F41B 5/105 124/900
5,934,265 A * 8/1999 Darlington ..... F41B 5/10 124/900
6,360,735 B1 * 3/2002 Larson ..... F41B 5/105 124/900
6,470,870 B1 * 10/2002 Schaar ..... F41B 5/10 124/25.6
6,474,324 B1 * 11/2002 Despart ..... F41B 5/105 124/25.6
6,688,295 B1 * 2/2004 Miller ..... F41B 5/105 124/900
6,776,148 B1 * 8/2004 Islas ..... F41B 5/105 124/25.6
7,441,555 B1 * 10/2008 Larson ..... F41B 5/10 124/25.6
7,637,256 B2 * 12/2009 Lee ..... F41B 5/10 124/25.6
8,037,876 B1 * 10/2011 Yehle ..... F41B 5/10 124/25.6
8,387,603 B2 * 3/2013 Darlington ..... F41B 5/105 124/25
8,651,095 B2 * 2/2014 Islas ..... F41B 5/123 124/900
8,833,349 B2 * 9/2014 Park ..... F41B 5/0094 124/25.6
8,881,714 B1 * 11/2014 Cooper ..... F41B 5/105 124/90
8,960,173 B2 * 2/2015 Okupniak ..... F41B 5/105 124/900
8,991,375 B2 * 3/2015 McPherson ..... F41B 5/105 124/24.1
8,991,719 B2 3/2015 McPherson
9,068,791 B2 * 6/2015 McPherson ..... F41B 5/148
9,234,719 B1 * 1/2016 Kempf ..... F41B 5/12
9,243,861 B1 * 1/2016 Kempf ..... F41B 5/12
9,310,155 B2 * 4/2016 Langley ..... F41B 5/105
9,377,267 B1 * 6/2016 Kempf ..... F41B 5/105
9,453,698 B1 * 9/2016 Grace ..... F41B 5/1411
9,494,379 B2 * 11/2016 Yehle ..... F41B 5/10
9,506,714 B1 * 11/2016 Eacker ..... F41B 5/105
9,513,079 B1 * 12/2016 Missel ..... F41B 5/143
9,746,275 B1 * 8/2017 Popov ..... F41B 5/105
9,829,268 B1 * 11/2017 Kempf ..... F41B 5/105
9,879,936 B2 * 1/2018 Yehle ..... F41B 5/105
9,879,938 B1 * 1/2018 Isenhower ..... F41B 5/123
10,048,036 B1 * 8/2018 Kempf ..... F41B 5/105
10,139,191 B1 * 11/2018 Kempf ..... F41B 5/123
10,267,592 B2 * 4/2019 Bartels ..... F41B 5/123
10,386,151 B2 8/2019 McPherson
10,473,418 B2 * 11/2019 Shaffer ..... F41B 5/123
10,514,226 B2 * 12/2019 Shaffer ..... F41B 5/105
10,634,447 B2 * 4/2020 Smith ..... F41B 5/123
10,739,103 B2 8/2020 McPherson
10,767,956 B2 * 9/2020 Popov ..... F41B 5/123
10,962,322 B2 * 3/2021 Yehle ..... F41B 5/066
10,989,492 B1 * 4/2021 Kempf ..... F41B 5/105
11,022,398 B1 * 6/2021 Kempf ..... F41B 5/105
11,085,728 B2 * 8/2021 Yehle ..... F41B 5/105
11,112,205 B1 * 9/2021 Kempf ..... F41B 5/123
11,268,780 B2 * 3/2022 Stanziale ..... F41B 5/105
11,371,795 B1 * 6/2022 Kempf ..... F41B 5/105
2008/0135032 A1 * 6/2008 Islas ..... F41B 5/10 124/90
2010/0269808 A1 * 10/2010 Evans ..... F41B 5/10 124/86
2011/0030666 A1 * 2/2011 Darlington ..... F41B 5/105 124/25
2015/0300767 A1 10/2015 Evans
2017/0370673 A1 * 12/2017 Yehle ..... F41B 5/10

OTHER PUBLICATIONS

Hoyt 2008 Product Guide, Hoyt Archery, Inc., Salt Lake City, UT (published 2008).

* cited by examiner

ARCHERY BOW WITH PASS THROUGH CABLING

CROSS-REFERENCE TO RELATED APPLICATIONS

This application claims the benefit and is a continuation of U.S. patent application Ser. No. 16/546,051, filed Aug. 20, 2019, which claims the benefit and is a continuation of U.S. patent application Ser. No. 15/892,309, filed Feb. 8, 2018, which claims the benefit of U.S. Patent Application No. 62/457,100, filed Feb. 9, 2017, the entire content of which are hereby incorporated herein by reference.

BACKGROUND OF THE INVENTION

This invention relates to archery bows and more specifically to compound archery bows.

Compound bows having bowstring and cable segments are generally known.

As archery bows achieve higher efficiency levels, there remains a need for higher performing compound bows that provide high speed shooting using novel structures that are more accurate, lighter in weight and/or more reliable that prior designs.

All US patents and applications and all other published documents mentioned anywhere in this application are incorporated herein by reference in their entirety.

Without limiting the scope of the invention a brief summary of some of the claimed embodiments of the invention is set forth below. Additional details of the summarized embodiments of the invention and/or additional embodiments of the invention may be found in the Detailed Description of the Invention below.

A brief abstract of the technical disclosure in the specification is provided as well only for the purposes of complying with 37 C.F.R. 1.72. The abstract is not intended to be used for interpreting the scope of the claims.

BRIEF SUMMARY OF THE INVENTION

In some embodiments, a bow comprises a frame, a first limb arranged to support a first rotatable member and a second limb arranged to support a second rotatable member. The first rotatable member comprises a first side, a second side, a bowstring track, a first cable track and a pass-through aperture. The bowstring extends between the first rotatable member and the second rotatable member. A first power cable comprises a first segment, a pass-through segment and a second segment. The first segment is oriented to the first side of the first rotatable member. The pass-through segment is oriented in the pass-through aperture and the third segment is oriented to the second side of the first rotatable member.

In some embodiments, a bow comprises a frame, a first limb arranged to support a first rotatable member and a second limb arranged to support a second rotatable member. The first rotatable member comprises a first side, a second side, a bowstring track, a cable track and a pass-through aperture, the cable track located on the first side. A bowstring extends between the first rotatable member and the second rotatable member. A power cable is arranged to be taken up on the cable track. The power cable passes through the pass-through aperture and attaches to a cable post located on said second side.

In some embodiments, a bow comprises a first limb supporting a first rotatable member. The first rotatable member comprises a first bowstring track and a first terminal post. A second limb supports a second rotatable member. The second rotatable member comprising a second bowstring track and a second terminal post. A bowstring comprises a first end attached to the first terminal post and a second end attached to the second terminal post. The first bowstring track and the second bowstring track are oriented in a bowstring plane, and the first terminal post is laterally offset from the bowstring plane.

These and other embodiments which characterize the invention are pointed out with particularity in the claims annexed hereto and forming a part hereof. However, for a better understanding of the invention, its advantages and objectives obtained by its use, reference can be made to the drawings which form a further part hereof and the accompanying descriptive matter, in which there are illustrated and described various embodiments of the invention.

BRIEF DESCRIPTION OF THE DRAWINGS

A detailed description of the invention is hereafter described with specific reference being made to the drawings.

DETAILED DESCRIPTION OF THE INVENTION

Figure 1:
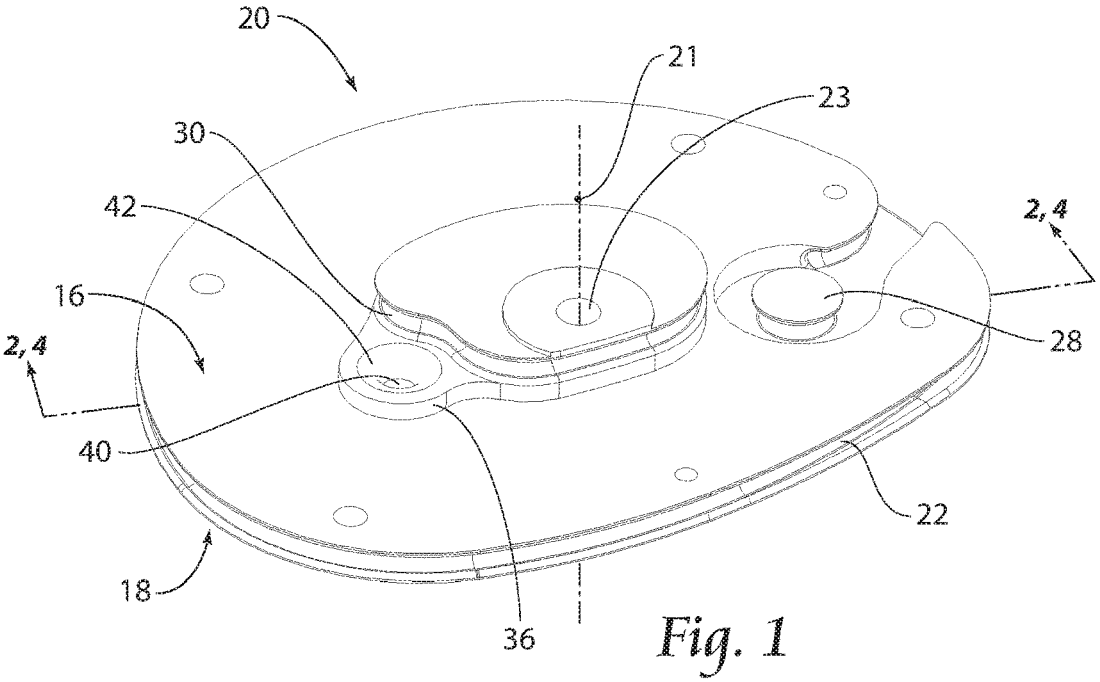
FIGS. 1-5 show different views of an embodiment of a rotatable member suitable for use in an archery bow.

While this invention may be embodied in many different forms, there are described in detail herein specific embodiments of the invention. This description is an exemplification of the principles of the invention and is not intended to limit the invention to the particular embodiments illustrated.

For the purposes of this disclosure, like reference numerals in the figures shall refer to like features unless otherwise indicated.

FIG. 1 shows an embodiment of a rotatable member 20 suitable for use in a compound bow. Desirably, a rotatable member 20 comprises a bowstring track 22 arranged to receive a bowstring and a cable track 30 arranged to receive a cable.

Desirably, the rotatable member 20 is arranged to rotate about a rotation axis 21. In some embodiments, the rotatable member 20 comprises an aperture 23 arranged to receive an axle. In some embodiments, the aperture 23 defines the rotation axis 21.

In some embodiments, the rotatable member 20 comprises a terminal post 28. In some embodiments, a terminal post 28 is provided adjacent to the bowstring track 22, and a bowstring can be anchored to the terminal post 28.

In some embodiments, a rotatable member 20 includes only one terminal post 28—for example, a terminal post 28 can be provided for a bowstring, and the rotatable member 20 does not include additional terminal posts. In some embodiments, a power cable does not terminate on the rotatable member 20. In some other embodiments, a rotatable member 20 includes multiple terminal posts 28, such as one post for the bowstring and one post for each cable segment of an archery bow. A rotatable member 20 can include any suitable number of terminal posts 28.

Desirably, the rotatable member 20 comprises a first side 16 and a second side 18. In some embodiments, the bowstring track 22 defines a plane, and the first side 16 and second side 18 are located on opposite sides of the plane. In some embodiments, the bowstring track 22 comprises a width dimension, and structure located to either the first side 16 or the second side 18 of the bowstring track 22 is not contained in the bowstring track 22 width dimension.

Desirably, the rotatable member 20 comprises at least one pass-through aperture 40 arranged to provide communication between the first side 16 and second side 18. Desirably, the pass-through aperture 40 is configured to receive a cable or bowstring of an archery bow, allowing the bowstring or cable to pass through the rotatable member 20.

In some embodiments, a pass-through aperture 40 comprises a flared end portion 42. In some embodiments, both ends of the pass-through aperture 40 comprise a flared end portion 42. In some embodiments, a flared end 42 increases in size as the pass-through aperture 40 is traversed toward an end.

In some embodiments, a rotatable member 20 comprises a raised flange 36 that extends outward from a main body of the rotatable member 20. In some embodiments, a pass-through aperture 40 extends through the raised flange 36. In some embodiments, a raised flange 36 is provided on one or both sides 16, 18 of the rotatable member 20. In some embodiments, the presence of a raised flange 36 provides a pass-through aperture 40 having a greater length.

Figure 2:
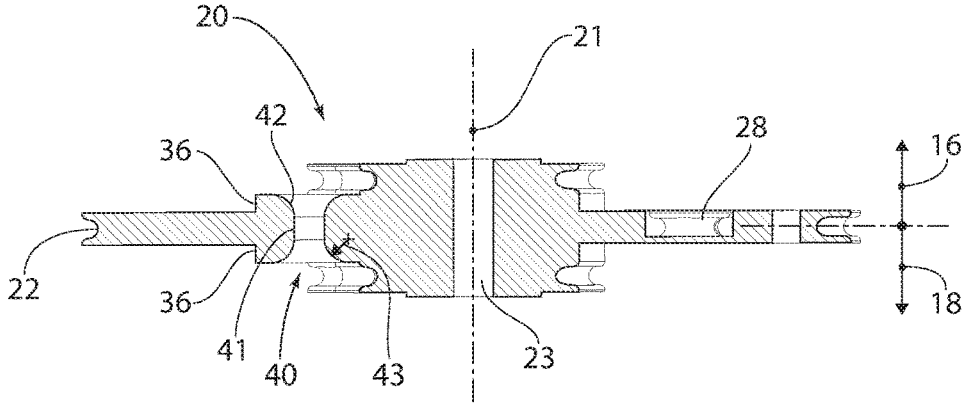

FIG. 2 shows a sectional view of the rotatable member 20 of FIG. 1. A cross-sectional profile of an embodiment of a pass-through aperture 40 is shown in detail in FIG. 2.

Various embodiments of a pass-through aperture 40 can have any suitable shape. In some embodiments, a pass-through aperture 40 is oriented normal to a surface of the rotatable member 20, and a transition from the pass-through aperture 40 to the rotatable member surface forms a right angle, similar to the arrangement shown for the axle aperture 23. In some embodiments, a pass-through aperture 40 excludes angles or sharp corners. In some embodiments, one end or both ends of a pass-through aperture 40 comprise curvature, and one or more portions of the sidewall 41 defining the pass-through aperture 40 are convex with respect to a central axis of the pass-through aperture 40.

In some embodiments, the sidewall 41 defining the pass-through aperture 40 defines a radius of curvature. In some embodiments, each end of the pass-through aperture 40 defines a radius of curvature. In some embodiments, the sidewall 41 is curved continuously along its length. In some embodiments, a single radius of curvature extends from the first side 16 of the rotatable member 20 to the second side 18.

In some embodiments, a pass-through aperture 40 comprises an opening formed in the rotatable member 20 that is oriented in the bowstring plane 24 and/or in a width dimension of the rotatable member 20 that is occupied by the bowstring track 22. In some embodiments, the pass-through aperture 40 comprises a first flared end portion 42 located to a first side 16 of the bowstring track 22, and a second flared end portion located to a second side 18 of the bowstring track 22.

Figure 3:
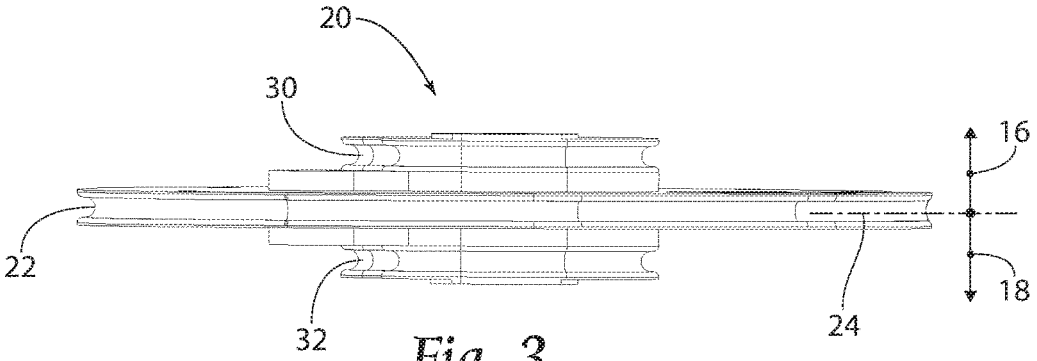
Figure 4:
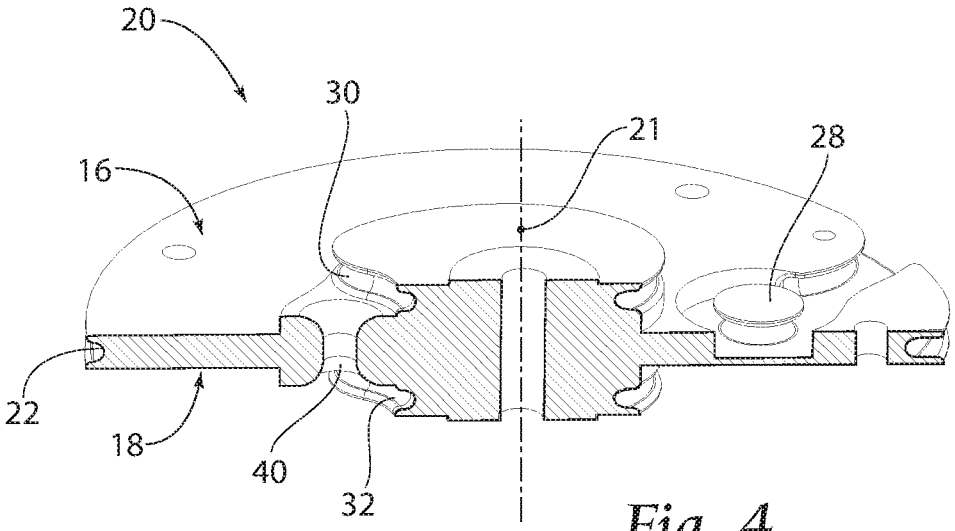

FIG. 3 shows a side view of the rotatable member 20 of FIG. 1, and FIG. 4 shows a partial sectional view. In some embodiments, a rotatable member 20 comprises a first cable track portion 30 oriented on the first side 16, and a second cable track portion 32 oriented on the second side 18. In some embodiments, the first cable track portion 30 and the second cable track portion 32 have similar shapes. In some embodiments, the shape of the second cable track portion 32 comprises a mirror image of the shape of the first cable track portion 30. In some embodiments, the track portions 30, 32 are mirrored across a central axis of the rotatable member 20. In some embodiments the track portions 30, 32 are mirrored across a central plane 24 of the rotatable member 20. In some embodiments the track portions 30, 32 are mirrored across a plane defined by the bowstring track 22.

Figure 5:
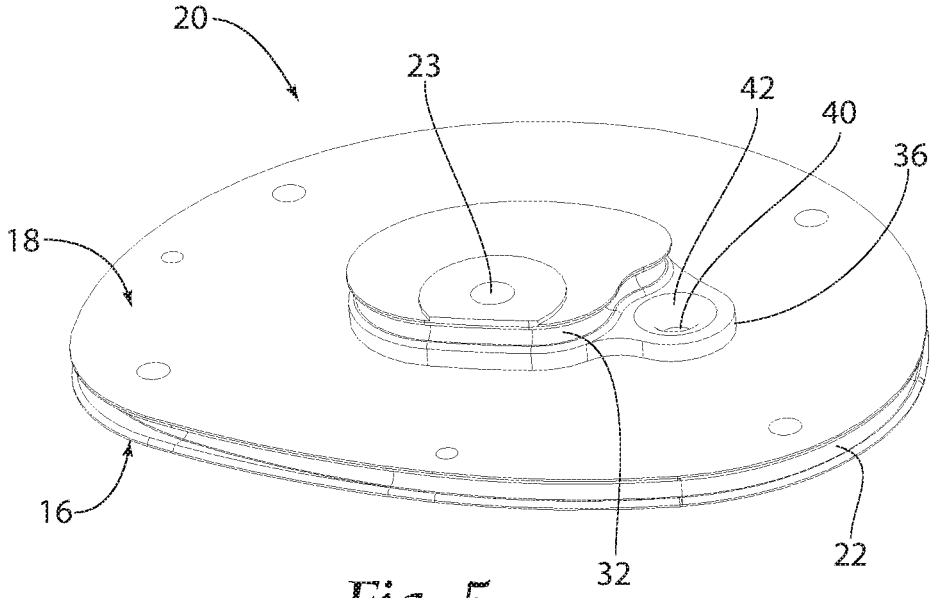

FIG. 5 shows the rotatable member 20 of FIG. 1 from another angle, where components located on the second side 18 are visible.

Figure 6:
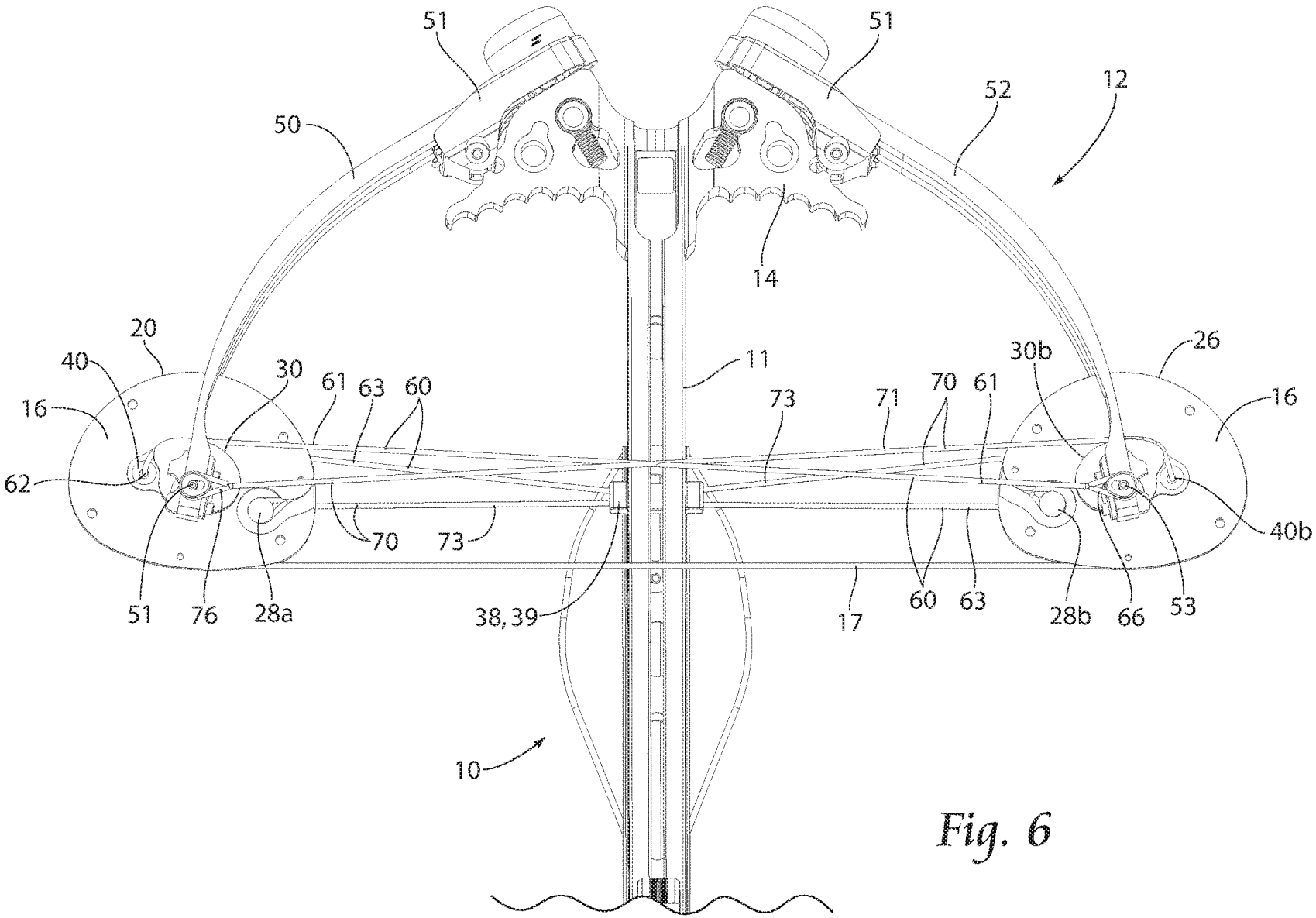
FIGS. 6-12 show an embodiment of a crossbow comprising rotatable members.

FIG. 6 shows an embodiment of a crossbow 10. In some embodiments, a crossbow 10 comprises a bow portion 12 comprising a rotatable member 20 comprising a pass-through aperture 40.

In some embodiments, a bow portion 12 comprises a prod 14 that supports a first limb 50 and a second limb 52. In some embodiments, a prod 14 comprises features as discussed in US 2014/0069404, the entire disclosure of which is hereby incorporated herein by reference. In some embodiments, one or more limb cups 15 are used. In some embodiments, the prod 14 supports a limb cup 15, and the limb cup 15 supports a limb 50. In some embodiments, limb cups 15 have features as disclosed in U.S. Pat. No. 8,453,635, the entire disclosure of which is hereby incorporated herein by reference.

Desirably, the first limb 50 supports a first rotatable member 20. In some embodiments, the first limb 50 supports a first axle 51, and the first axle 51 supports the first rotatable member 20. In some embodiments, the second limb 52 supports a second rotatable member 26. In some embodiments, the second limb 52 supports a second axle 53, and the second axle 53 supports the second rotatable member 26.

In some embodiments, the first rotatable member 20 and the second rotatable member 26 have shapes that are related by symmetry. In some embodiments, the first rotatable member 20 and the second rotatable member 26 have the same shape. In some embodiments, the first rotatable member 20 comprises a mirror image of the second rotatable member 26.

Desirably, the bow portion 12 comprises a bowstring 17. In some embodiments, a first end of the bowstring 17 is attached to a terminal post 28*a* on the first rotatable member 20, and a second end of the bowstring 17 is attached to a terminal post 28*b* on the second rotatable member 26.

FIGS. 7-12 show the crossbow 10 of FIG. 6 from different viewing angles. With reference to FIG. 6-12, desirably, the bow portion 12 comprises a power cable 60 arranged to be taken up on a cable track 30 as the bowstring 17 is drawn.

In some embodiments, a portion of the power cable 60 passes through the pass-through aperture 40 of the first rotatable member 20.

In some embodiments, the power cable 60 comprises a first segment 61 oriented to the first side 16 of the first rotatable member 20, a pass-through segment 62 oriented in the pass-through aperture 40 of the first rotatable member 20 and a second segment 63 oriented to the second side 18 of the first rotatable member 20. In some embodiments, a portion of the first segment 61 is taken up by the first cable track 30 when the bow is drawn, and a portion of the second segment 63 is taken up by the second cable track 32 when the bow is drawn.

Figure 7:
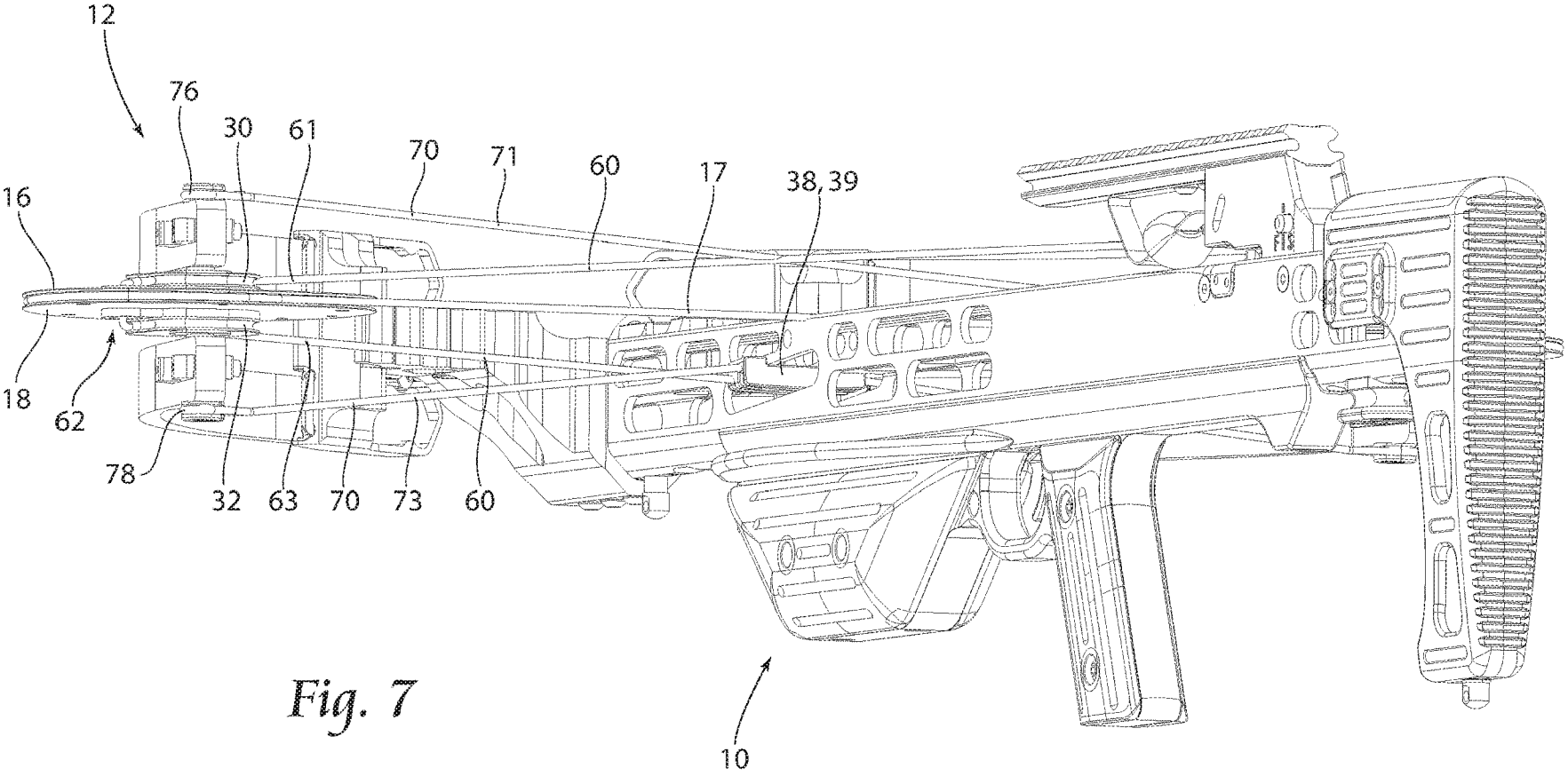
Figure 8:
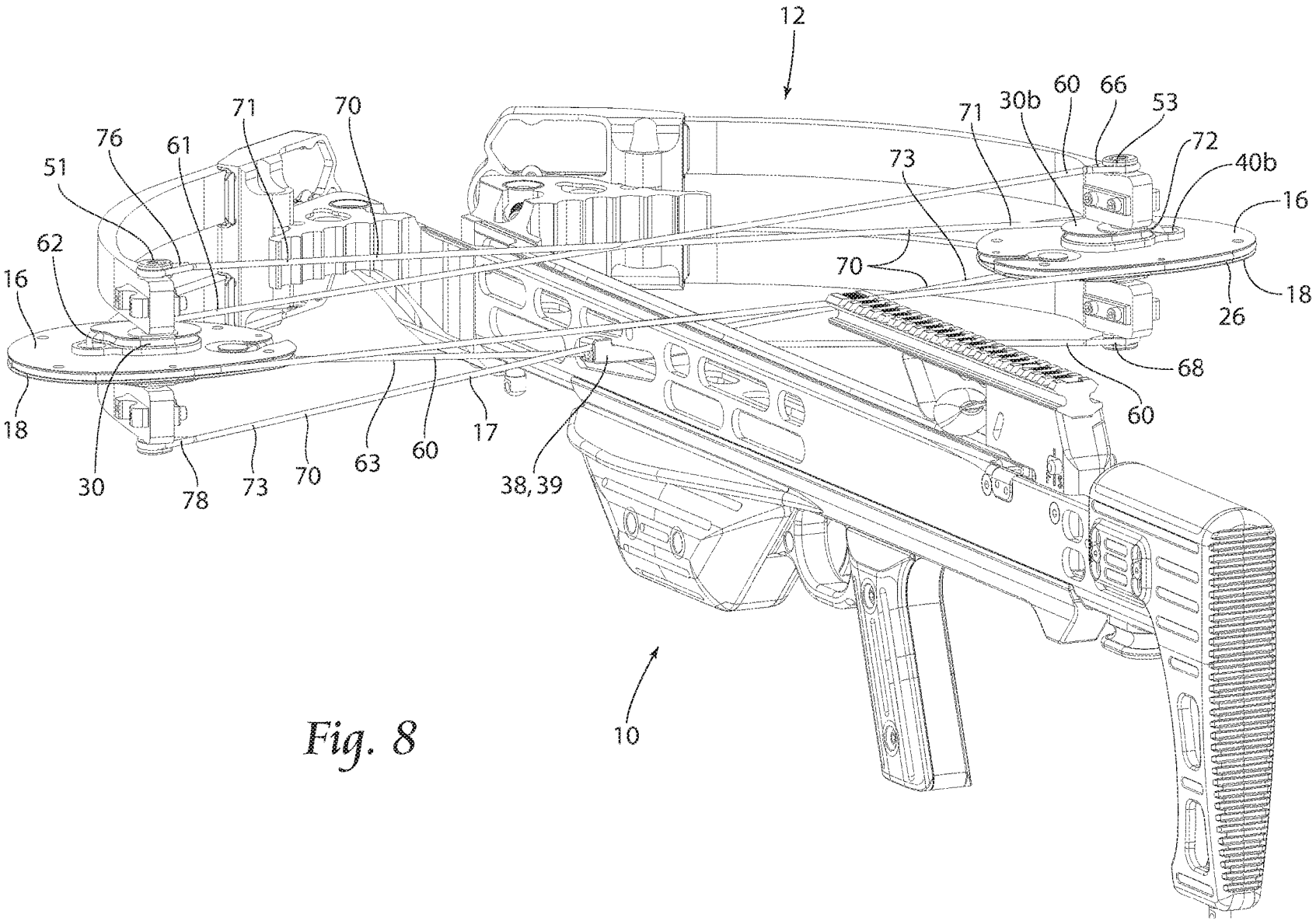
Figure 9:
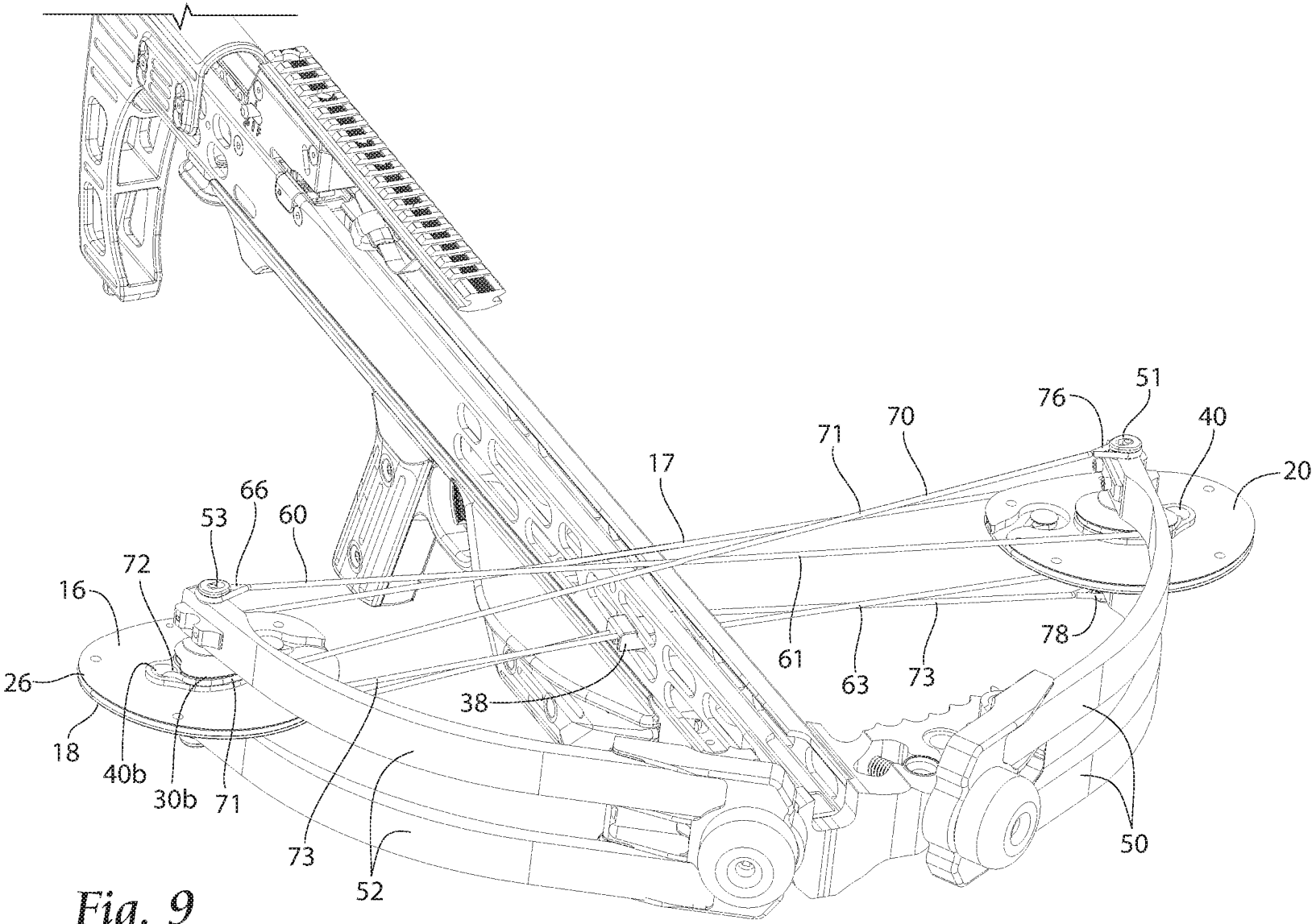
Figure 10:
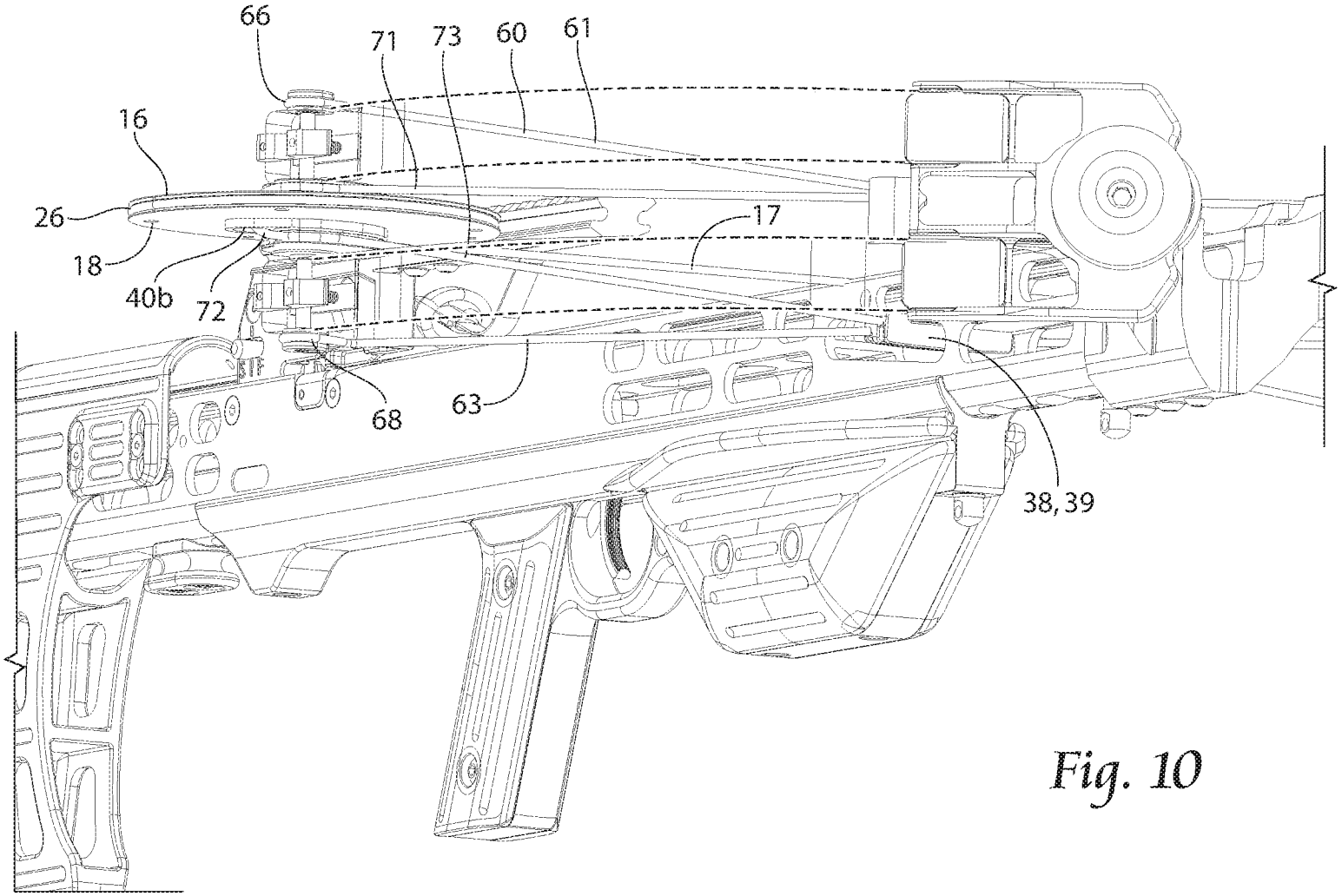
Figure 11:
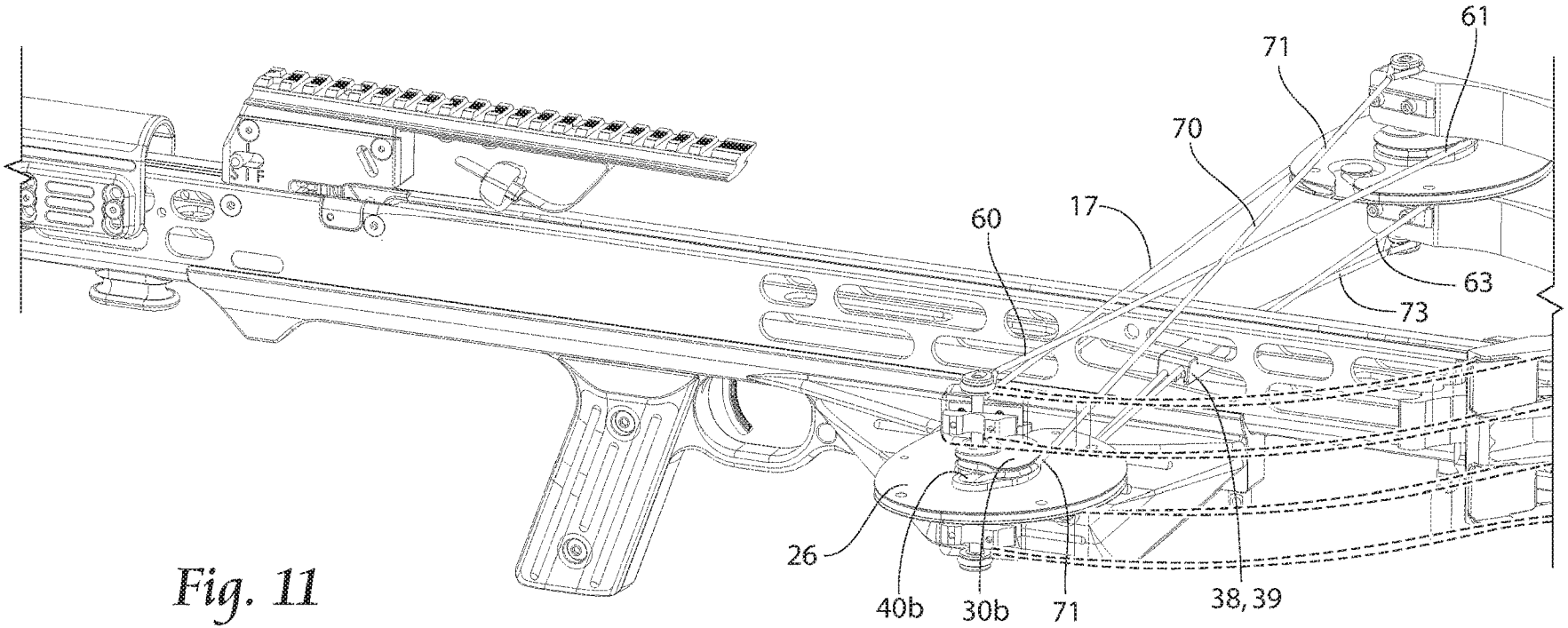
Figure 12:
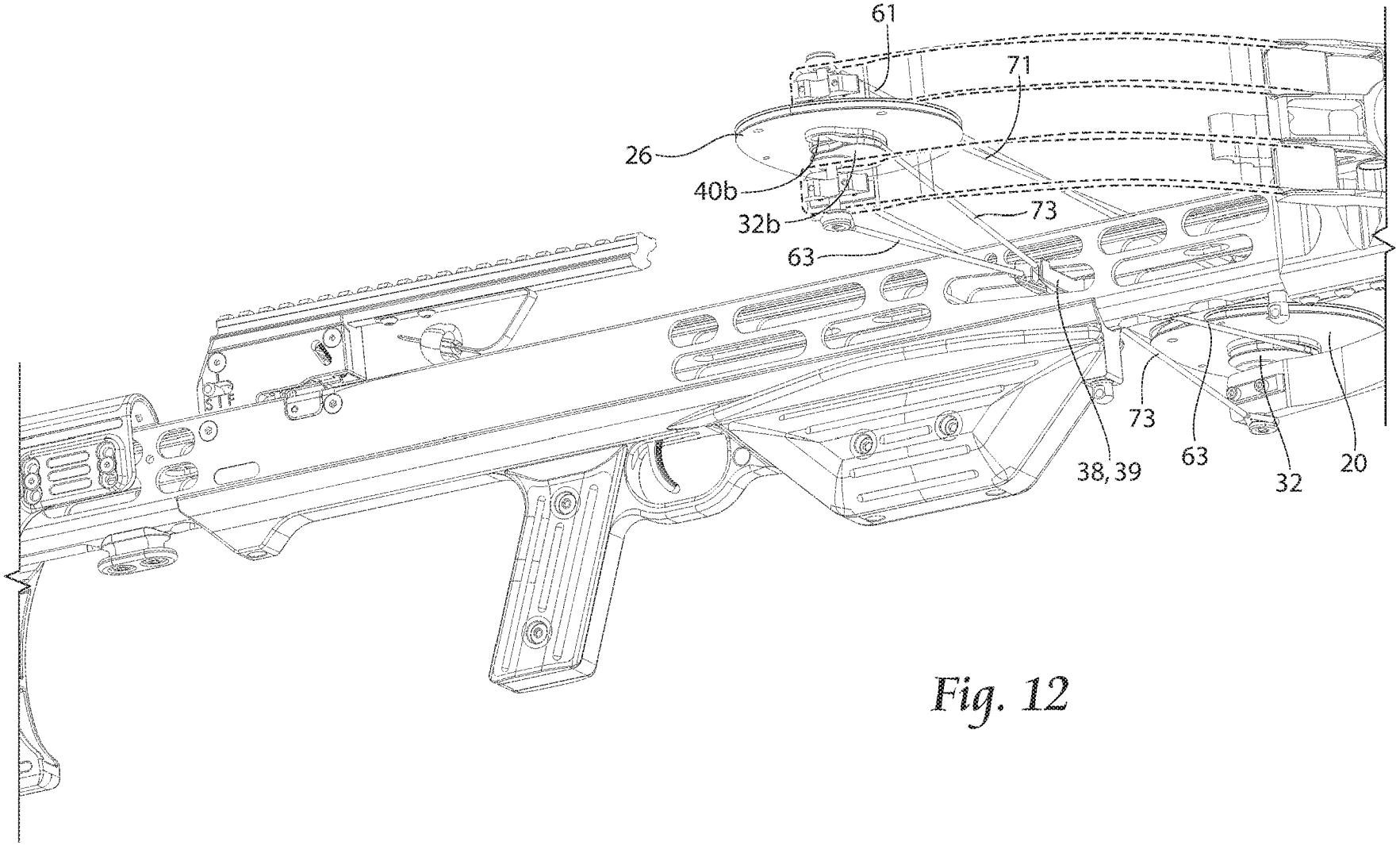

In some embodiments, the power cable 60 comprises a first end 66 and a second end 68. In some embodiments, the segments 61, 63 of the power cable 60 extend away from the first rotatable member 20 and attach to other portions of the bow portion 12 or crossbow 10. As shown in FIGS. 6-8, the ends 66, 68 of the power cable 60 attach to respective ends of the second axle 53. In some other embodiments, the ends 66, 68 can attach to the second rotatable member 26, or any other suitable portion of the crossbow 10, such as a limb 52, the prod 14, the stock 11, etc. In some embodiments, one or both ends 66, 68 attach to a dynamic anchor structure that can provide for force vectoring, rotatable member synchronization, etc., for example as disclosed in U.S. Pat. Nos. 6,990,970, 7,946,281 or 8,020,544, the entire disclosures of which are hereby incorporated herein by reference.

In some embodiments, the power cable 60 as described herein comprises a first power cable 60, and the bow portion 12 further comprises a second power cable 70.

In some embodiments, the second rotatable member 26 comprises a first cable track 30*b* arranged to take up the second power cable 70 as the bow is drawn. In some embodiments, the second rotatable member 26 comprises a second cable track 32*b* arranged to take up the second power cable 70 as the bow is drawn. In some embodiments, the second rotatable member 26 comprises a pass-through aperture 40*b*, and a portion of the second power cable 70 passes through the pass-through aperture 40*b*.

In some embodiments, the second power cable 70 comprises a first segment 71 oriented to the first side 16 of the second rotatable member 26, a pass-through segment 72 oriented in the pass-through aperture 40*b* of the second rotatable member 26 and a second segment 73 oriented to the second side 18 of the second rotatable member 26. In some embodiments, a portion of the first segment 71 is taken up by the first cable track 30*b* when the bow is drawn, and a portion of the second segment 73 is taken up by the second cable track 32*b* when the bow is drawn.

In some embodiments, the second power cable 70 substantially mirrors the specifics of the first power cable 60.

In some embodiments, the second power cable 70 comprises a first end 76 and a second end 78. In some embodiments, the segments 71, 73 of the second power cable 70 extend away from the second rotatable member 26 and attach to other portions of the bow portion 12 or crossbow 10. In some embodiments, the ends 76, 78 of the second power cable 70 attach to respective ends of the first axle 51. In some other embodiments, the ends 76, 78 can attach to the first rotatable member 20, or any other suitable portion of the crossbow 10, such as a limb 50, the prod 14, the stock 11, etc. In some embodiments, one or both ends 76, 78 attach to a dynamic anchor structure.

In some embodiments, the cabling arrangement provides for self-balancing with respect to the sides 16, 18 of the rotatable members 20, 26. In some embodiments, the sides 16, 18 can be oriented with respect to a shooter in up and down directions, for example in a crossbow. In some embodiments, the sides 16, 18 can be oriented with respect to a shooter in left and right directions, for example in a vertically oriented bow.

In some embodiments, a power cable 60 will slip with respect to a pass-through aperture 40 in order to self-balance forces when necessary. In some embodiments, a portion of the power cable 60 that is oriented in the pass-through aperture 40 does not include a helical serving wrap. In some embodiments, the second portion 62, 72 of a power cable 60, 70 excludes a helical serving wrap. In some embodiments, portions adjacent to the second portion 62, 72 of the power cable 60, 70 include a serving. In some embodiments, portions of the first segment 61, 71 and/or portions of the second segment 63, 73 of the power cables 60, 70 that are taken up on a cam track (e.g. 30, 32) comprise a serving.

In some embodiments, a crossbow 10 comprises one or more cable biasing mechanism(s) 38 arranged to bias a cable 60, 70 in a lateral direction, for example biasing a cable segment away from a shooting axis. Any suitable cable biasing mechanism can be used.

In some embodiments, a biasing mechanism 38 comprises a cable slider 39 arranged to move with respect to the stock 11, for example as disclosed in US 20140069402, the entire content of which is hereby incorporated herein by reference.

In some embodiments, a biasing mechanism 38 engages a portion of the first power cable 60. In some embodiments, the biasing mechanism 38 engages a portion of the second power cable 70. In some embodiments, a biasing mechanism 38 engages a portion of the first power cable 60 and a portion of the second power cable 70. In some embodiments, multiple cable portions engaged by the biasing mechanism 38 cross one another within the biasing mechanism 38 (see e.g. FIGS. 6 and 12).

In some embodiments, a first biasing mechanism 38 is arranged to engage cable segments (e.g. 63, 73) located to one side (e.g. 18) of the rotatable members 20, 26, and a second biasing mechanism (not shown) is arranged to engage cable segments (e.g. 61, 71) located to the other side (e.g. 16) of the rotatable members 20, 26. In some embodiments, a second biasing mechanism biases cable segments 61, 71 laterally in a direction above a shooting axis, for example comprising a tunnel and slider, or rollers, as disclosed in U.S. Pat. No. 8,991,375, the entire disclosure of which is hereby incorporated herein by reference. In some embodiments, a second biasing mechanism comprises a cable slider arranged for two cable segments, for example as shown with respect to the cable slider 39 shown in FIGS. 6-12.

In some embodiments, a bow or crossbow 10 does not have cable biasing members arranged to bias cables 60, 70 in a lateral direction. In some embodiments, a bow or crossbow 10 comprises one or more biasing mechanisms (e.g. 38) in contact with cable segments (e.g. 63, 73) oriented to one side (e.g. 18) of the rotatable members 20, 26, and excludes biasing mechanism(s) on the other side (e.g. 16). In some embodiments, a bow or crossbow 10 comprises one or more biasing mechanisms (e.g. 38) in contact with cable segments (e.g. 63, 73) oriented to one side (e.g. 18) of the rotatable members 20, 26, and further comprises one or more biasing mechanisms in contact with cable segments (e.g. 61, 71) oriented to the other side (e.g. 16) of the rotatable members 20, 26.

Figure 13:
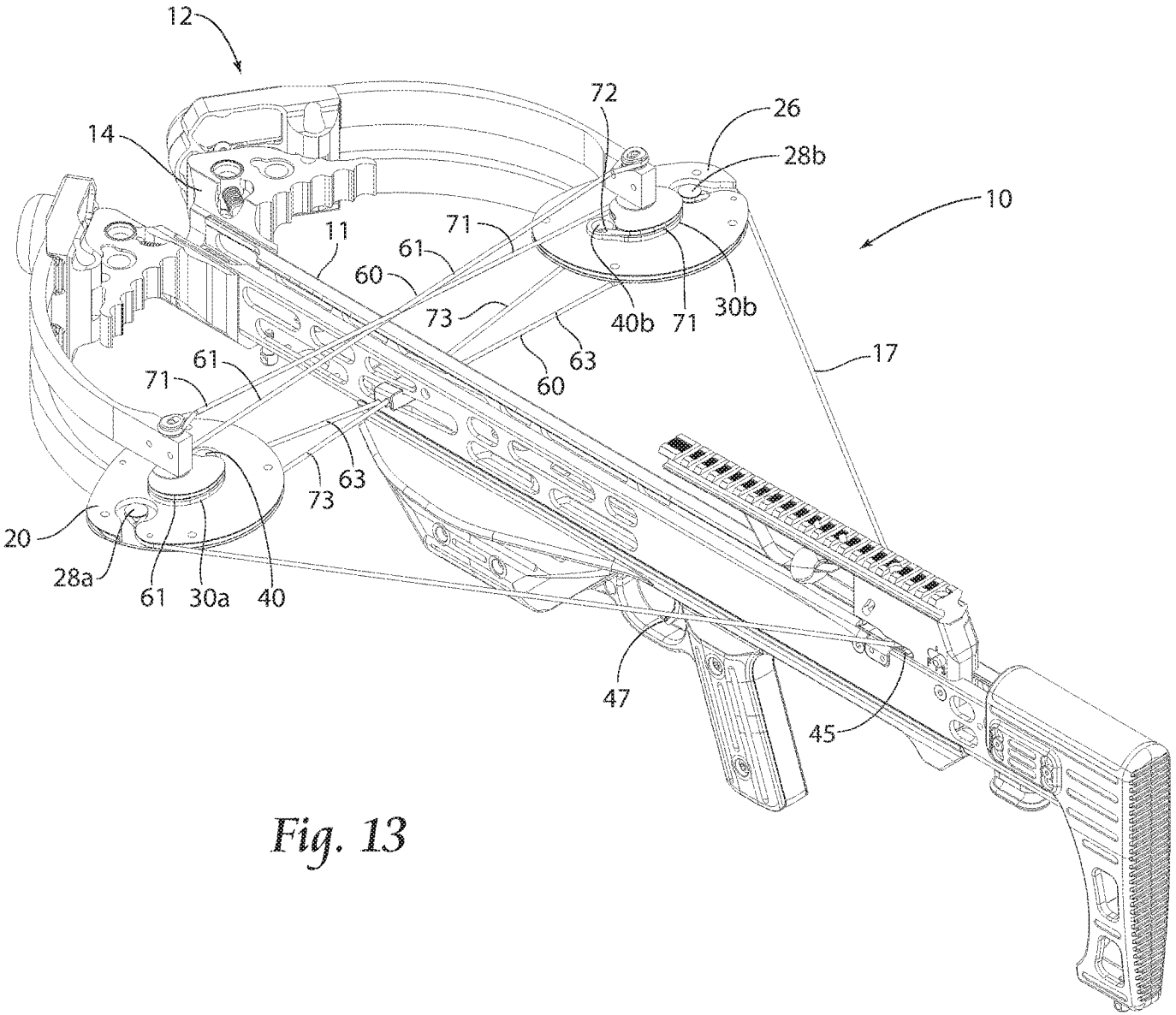
FIGS. 13-15 show the crossbow of FIG. 6 in a drawn orientation.
Figure 14:
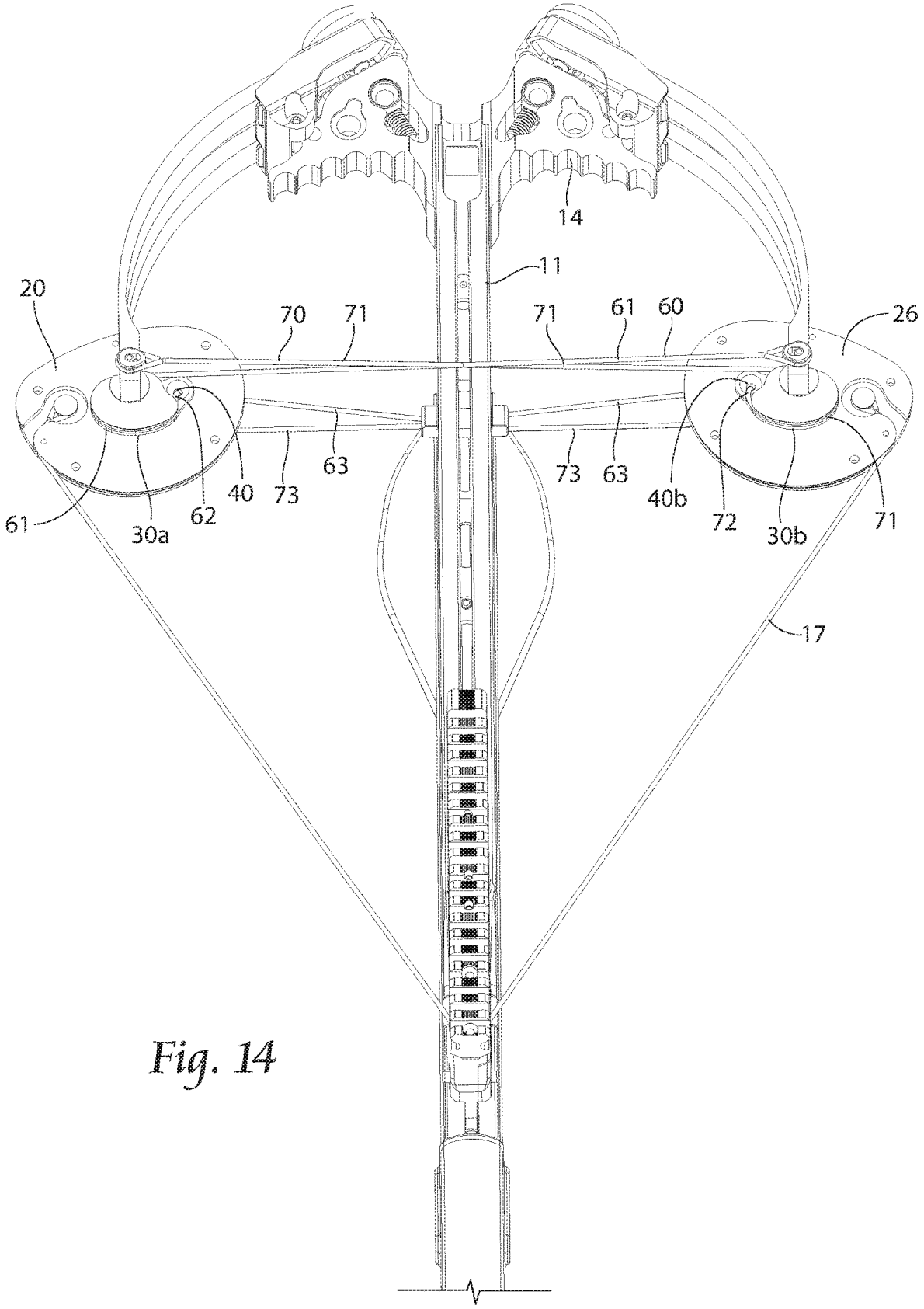
Figure 15:
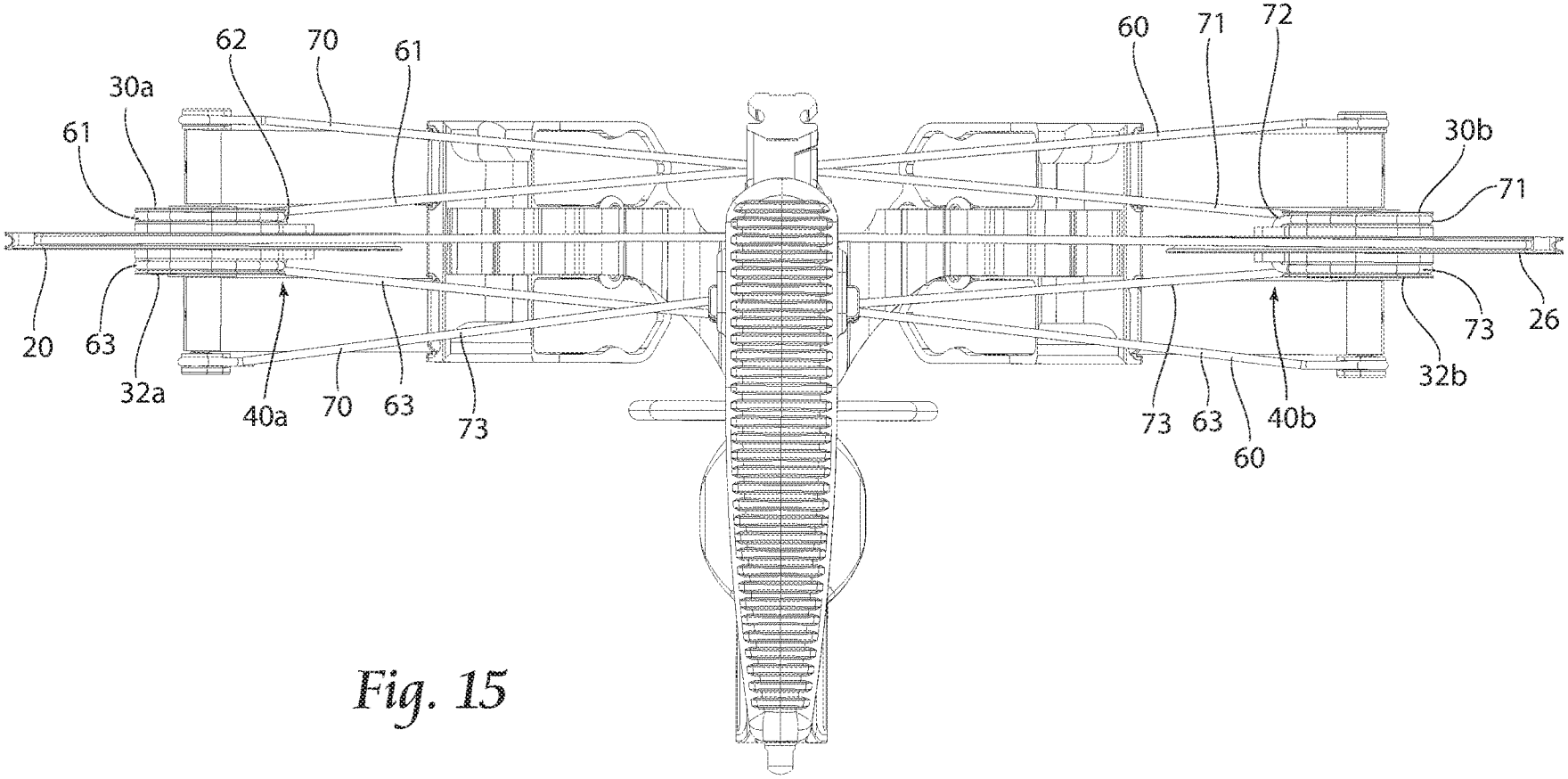

FIG. 13-15 show the crossbow 10 of FIG. 6 in a drawn orientation. Desirably, the bowstring 17 is retained in a drawn condition by a catch 45, and the catch 45 can be released by operating a trigger 47. In some embodiments, a crossbow 10 comprises features as disclosed in U.S. Pat. No. 9,022,013, the entire disclosure of which is hereby incorporated herein by reference.

In some embodiments, in the drawn condition, the first cable track 30*a* of the first rotatable member 20 is occupied by portion of the first segment 61 of the first power cable 60, and the second cable track 32*a* of the first rotatable member 20 is occupied by a portion of the second segment 63 of the first power cable 60. In some embodiments, in the drawn condition, the first cable track 30*b* of the second rotatable member 26 is occupied by portion of the first segment 71 of the second power cable 70, and the second cable track 32*b* of the second rotatable member 26 is occupied by a portion of the second segment 73 of the second power cable 70.

Figure 16:
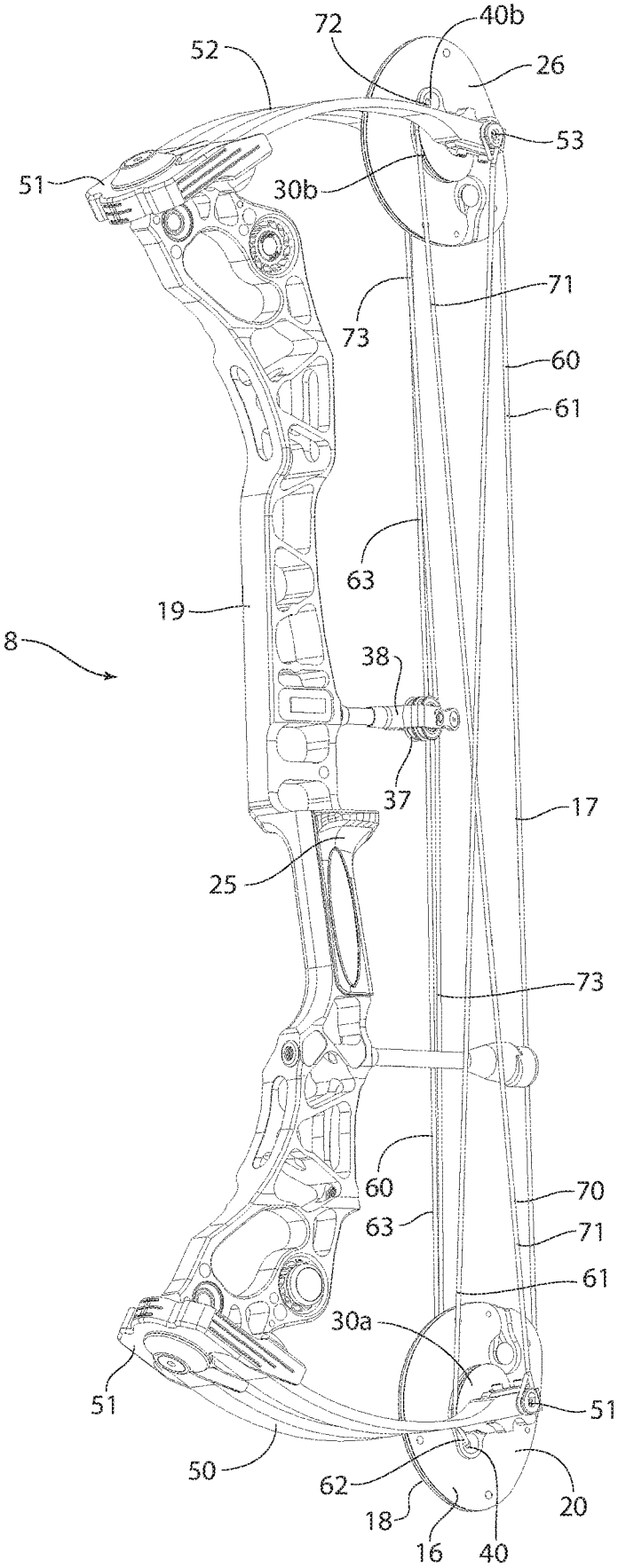
FIGS. 16-18 show an embodiment of an archery bow.
Figure 17:
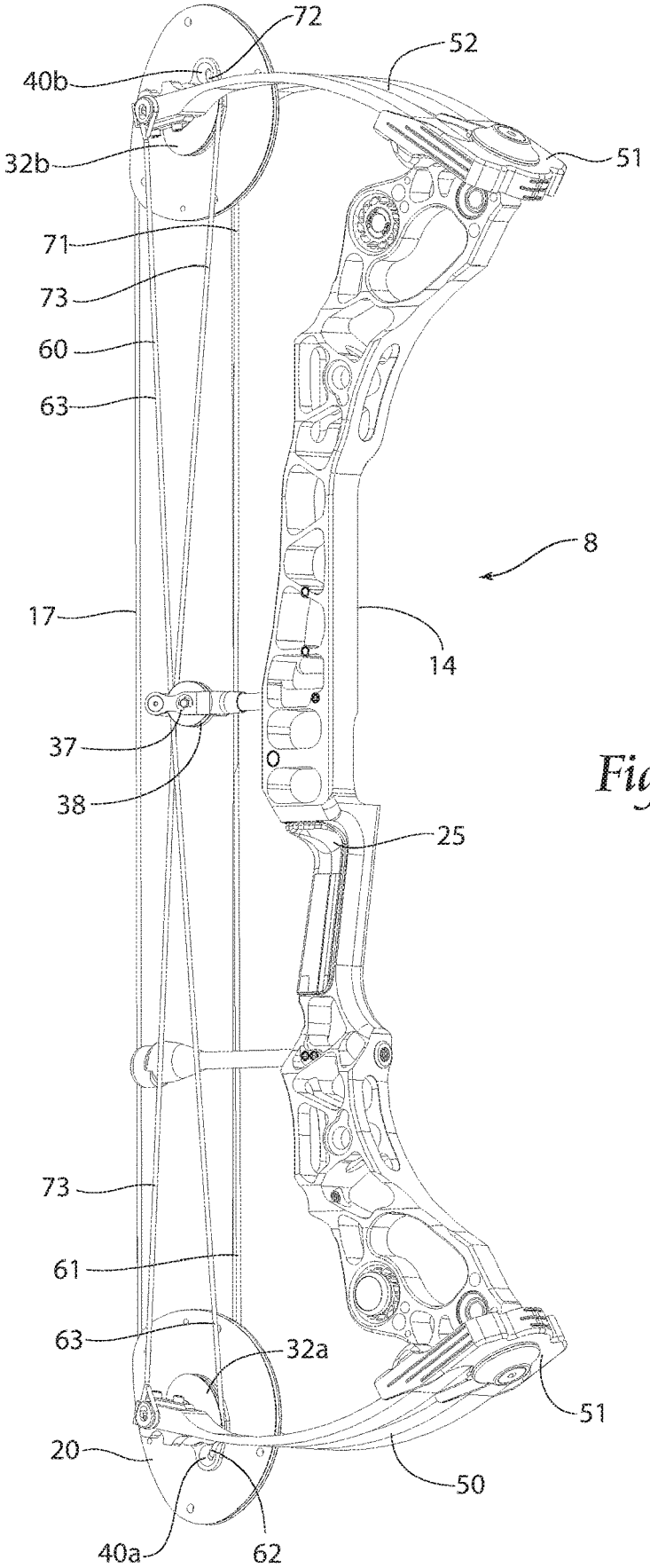
Figure 18:
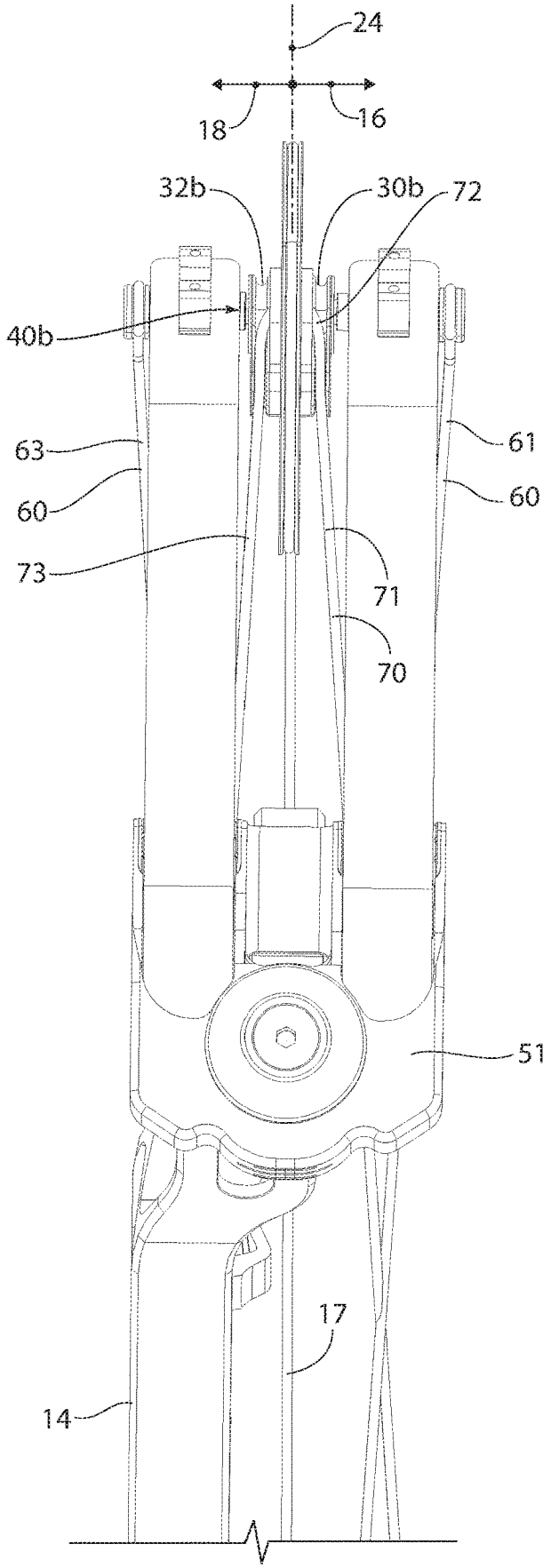

FIGS. 16-18 show an embodiment of a bow 8 comprising a rotatable member 20 having a pass through aperture 40. In some embodiments, a bow 8 comprises a riser 19 arranged to be vertically oriented when the bow 8 is used. Desirably, the riser 19 comprises a grip 25. In some embodiments, the bow 8 comprises a first power cable 60 and a second power cable 70 strung as described with respect to FIGS. 6-15.

In some embodiments, a bow 8 comprises one or more cable biasing mechanism(s) 38 arranged to bias one or more cable segments in a lateral direction. In some embodiments, a cable biasing mechanism 38 comprises a cable guard 37. In some embodiments, a cable guard 37 comprises a roller arranged to contact a cable segment.

In some embodiments, a bow 8 excludes cable biasing mechanisms.

In some embodiments, a bow 8 comprises a cable biasing mechanism 38 arranged to contact the first power cable 60 and the second power cable 70. In some embodiments, a cable biasing mechanism 38 contacts the second segment 63 of the first power cable 60 and the second segment 73 of the second power cable 70. In some embodiments, a bow 8 further comprises a second cable guard (not shown) arranged to contact the first segment 61 of the first power cable 60 and the first segment 71 of the second power cable 70.

In some embodiments, a bow portion 12 comprises rotatable members 20, 26 having bowstring tracks configured as disclosed in US 2015/0345889, the entire disclosure of which is hereby incorporated herein by reference.

Figure 19:
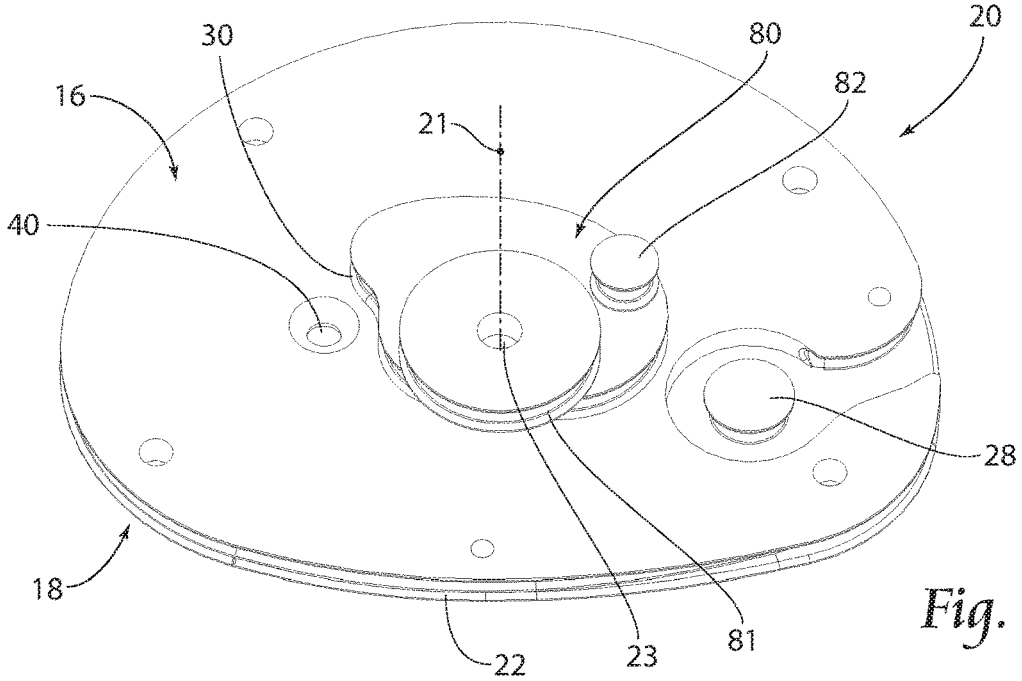
FIGS. 19-21 show another embodiment of a rotatable member.

FIG. 19 shows another embodiment of a rotatable member 20. In some embodiments, a rotatable member 20 comprises a dynamic anchoring arrangement 80. Desirably, a dynamic anchoring arrangement 80 comprises a structure arranged to move an end of a power cable as the bow is drawn. In some embodiments, the dynamic anchoring arrangement 80 comprises a portion suitable for termination of a cable.

In some embodiments, a dynamic anchoring arrangement 80 comprises a cable anchoring track 81. In some embodiments, the cable anchoring track 81 is fixed with respect to the rotatable member 20, for example being fixed with respect to the bowstring track 22. In some embodiments, the dynamic anchoring arrangement 80 comprises a cable post 82. In some embodiments, the cable post 82 is located directly adjacent to the cable anchoring track 81. In some embodiments, a power cable can be oriented in the cable anchoring track 81 and terminate on the cable post 82. When used in a bow, the power cable can be arranged to feed out from the cable anchoring track 81 as the bow is drawn.

Figure 20:
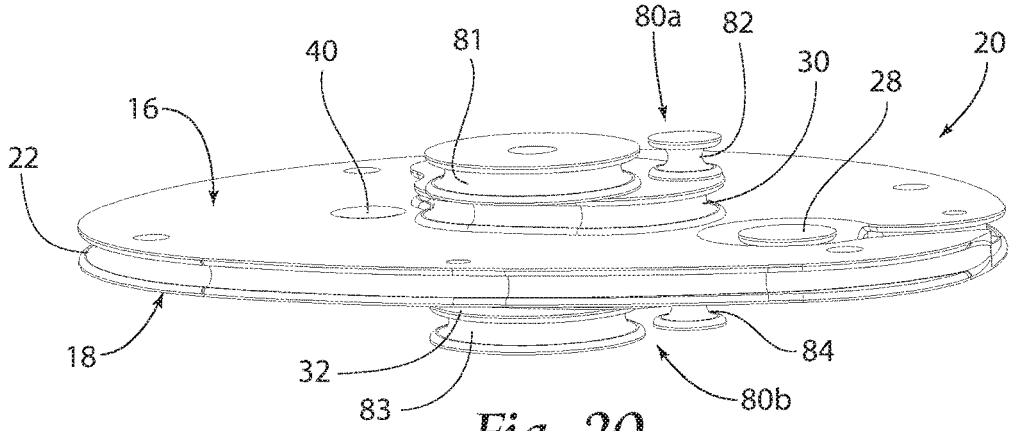
Figure 21:
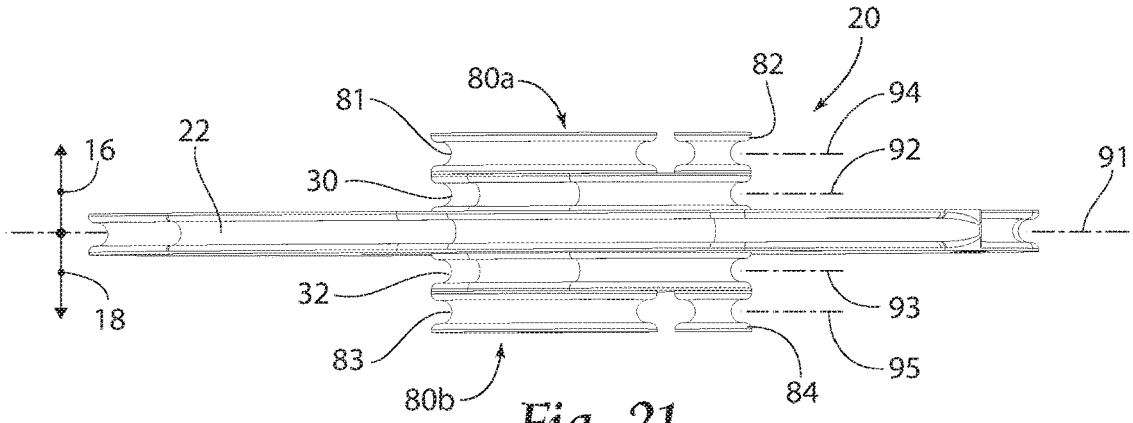

FIGS. 20 and 21 show additional views of the rotatable member 20 of FIG. 19. In some embodiments, a rotatable member 20 comprises a first dynamic anchoring arrangement 80*a* and a second dynamic anchoring arrangement 80*b*. In some embodiments, the first dynamic anchoring arrangement 80*a* is located to a first side 16 of the rotatable member 20, and the second dynamic anchoring arrangement 80*b* located to a second side of the rotatable member 20. In some embodiments, the second dynamic anchoring arrangement 80*b* comprises a second cable anchoring track 83. In some embodiments, the second cable anchoring track 83 is fixed with respect to the rotatable member 20, for example being fixed with respect to the bowstring track 22. In some embodiments, the second dynamic anchoring arrangement 80*b* comprises a second cable post 84. In some embodiments, the second cable post 84 is located directly adjacent to the second cable anchoring track 83. In some embodiments, a power cable can be oriented in the second cable anchoring track 83 and terminate on the second cable post 84. When used in a bow, the power cable can be arranged to feed out from the second cable anchoring track 83 as the bow is drawn.

In some embodiments, the first dynamic anchoring arrangement 80*a* and a second dynamic anchoring arrangement 80*b* comprise mirror images of one another, for example taken across a central plane of the rotatable member 20. In some embodiments, the bowstring track 22 is centered on the central plane of the rotatable member 20.

In some embodiments, a bowstring track 22 is located in a first plane 91, the first cable track 30 is located in a second plane 92, the second cable track 32 is located in a third plane 93, the first cable anchoring track 81 is located in a fourth plane 94 and the second cable anchoring track 83 is located in a fifth plane 95. In some embodiments, the planes 91, 92, 93, 94, 95 are all parallel to one another.

Figure 22:
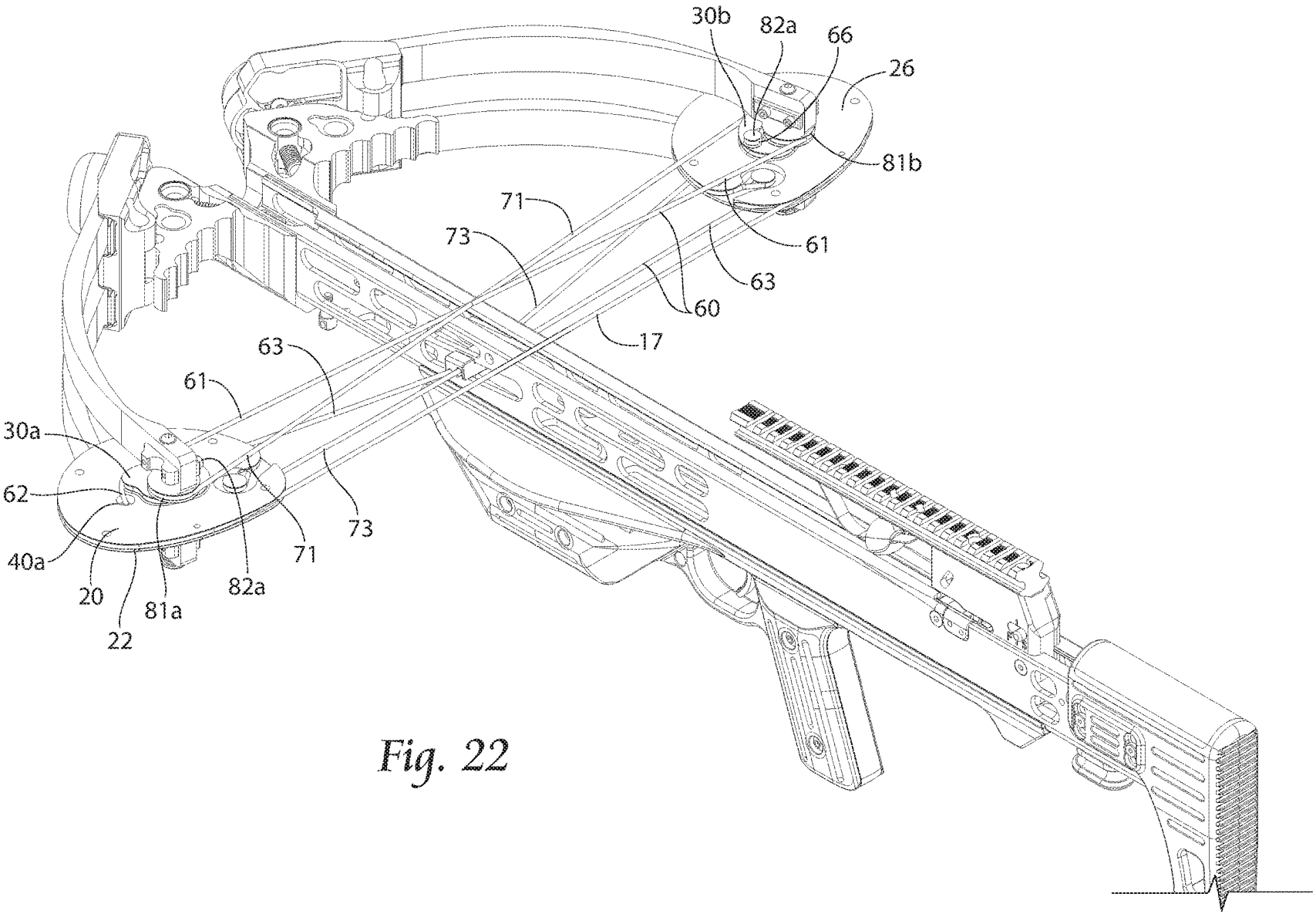
FIGS. 22-24 show an embodiment of a crossbow having a rotatable member as shown in FIG. 19.
Figure 23:
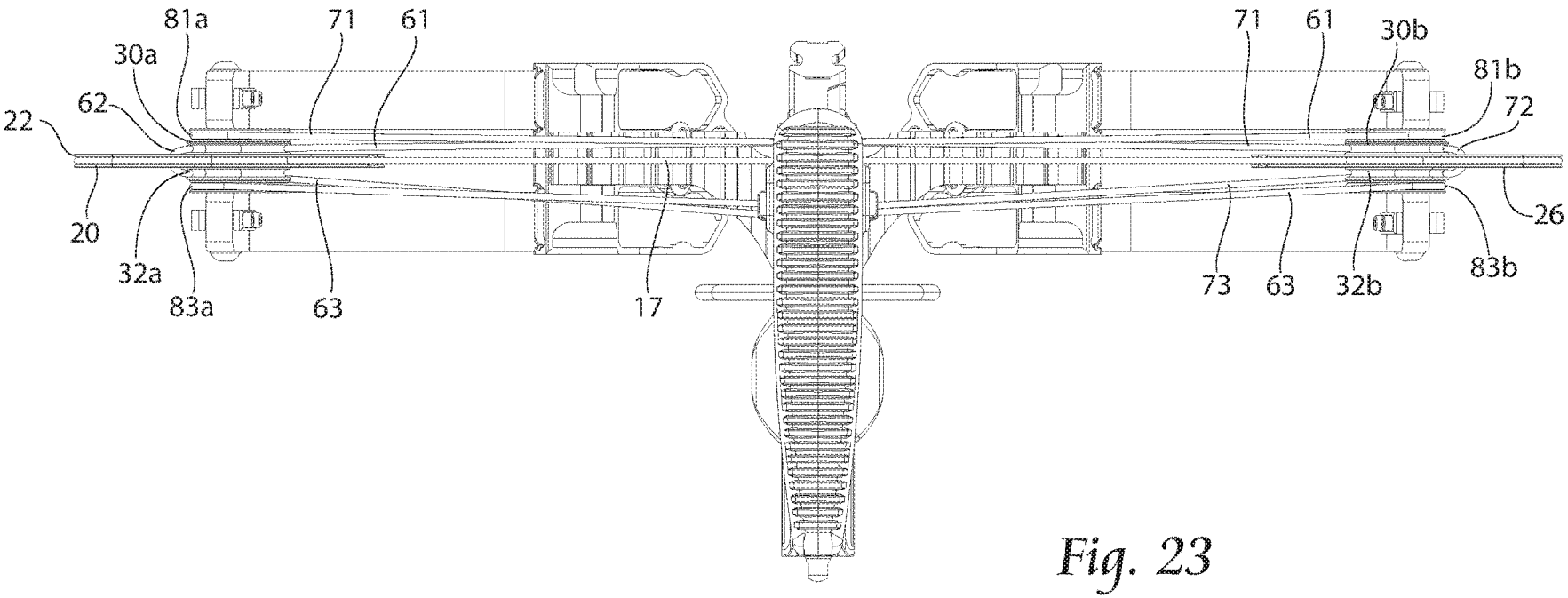
Figure 24:
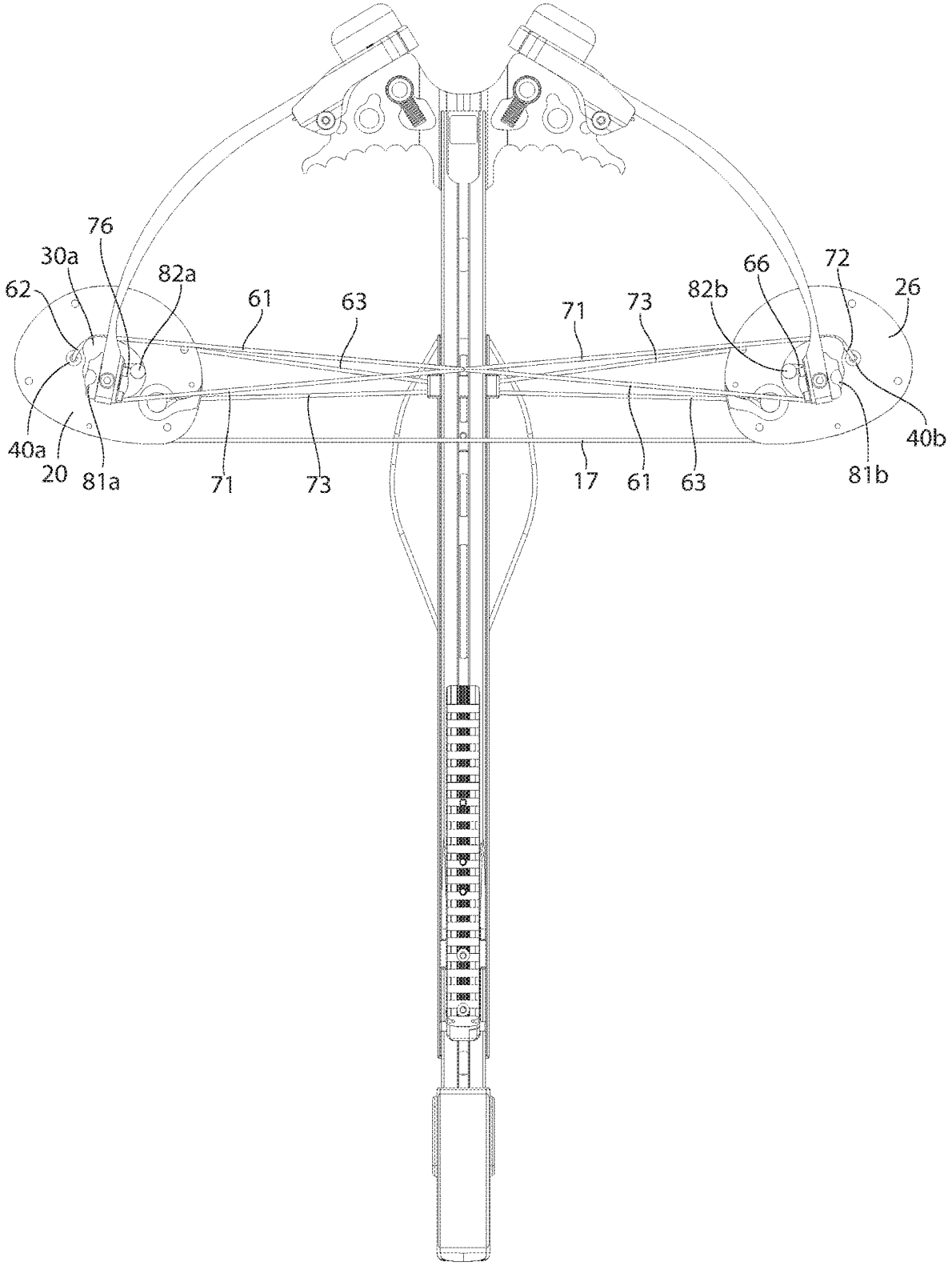

FIGS. 22-24 show an embodiment of a crossbow 10 comprising dynamic anchors 80.

In some embodiments, the first power cable 60 comprises a first end 66 engaged to a dynamic anchor. In some embodiments, the first end 66 is attached to a first cable post 82*b* of the second rotatable member 24, and the first segment 61 is oriented in the first cable anchoring track 81*b* of the second rotatable member 24. In some embodiments, the first segment 61 extends to the first rotatable member 22 and is oriented in or near the first cable track 30*a* of the first rotatable member 22. The first power cable 60 extends through the pass-through aperture 40*a* of the first rotatable member 22, and the second segment 63 is oriented in or near the second cable track 32*a* of the first rotatable member 22. The second segment 63 extends to the second rotatable member 24, and the second end 68 of the first power cable 60 is engaged with a dynamic anchor. The second segment 63 can be positioned in the second cable anchoring track 83*b* of the second rotatable member 24, and a second end 68 can attach to the second cable post 84 of the second rotatable member 24.

In some embodiments, the second power cable 70 comprises a first end 76 engaged to a dynamic anchor. In some embodiments, the first end 76 is attached to a first cable post 82*a* of the first rotatable member 22, and the first segment 71 is oriented in the first cable anchoring track 81*a* of the first rotatable member 22. In some embodiments, the first segment 71 extends to the second rotatable member 24 and is oriented in or near the first cable track 30*b* of the second rotatable member 24. The second power cable 70 extends through the pass-through aperture 40*b* of the second rotatable member 24, and the second segment 73 is oriented in or near the second cable track 32*b* of the second rotatable member 24. The second segment 73 extends to the first rotatable member 22, and the second end 78 of the second power cable 70 is engaged with a dynamic anchor. The second segment 73 can be positioned in the second cable anchoring track 83*a* of the first rotatable member 22, and a second end 78 can attach to the second cable post 84 of the second rotatable member 24.

In some embodiments, as the bowstring 17 is drawn and the rotatable members rotate, the first segment 61 is fed out from the first cable anchoring track 81*b* of the second rotatable member 24 and the second segment 63 is fed out from the second cable anchoring track 83*b* of the second rotatable member 24. In some embodiments, as the bowstring 17 is drawn and the rotatable members rotate, the first segment 71 is fed out from the first cable anchoring track 81*a* of the first rotatable member 22 and the second segment 73 is fed out from the second cable anchoring track 83*a* of the first rotatable member 22.

Figure 25:
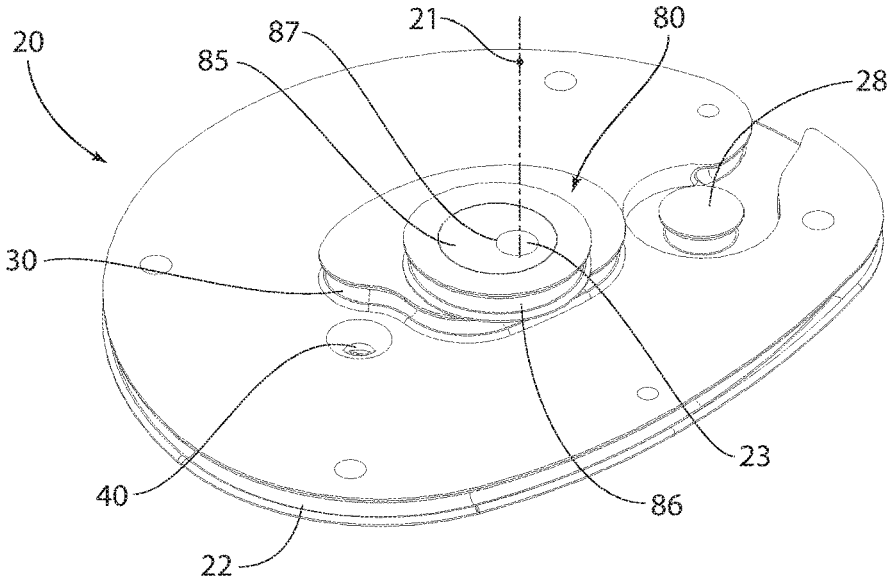
FIGS. 25-27 show another embodiment of a rotatable member.
Figure 26:
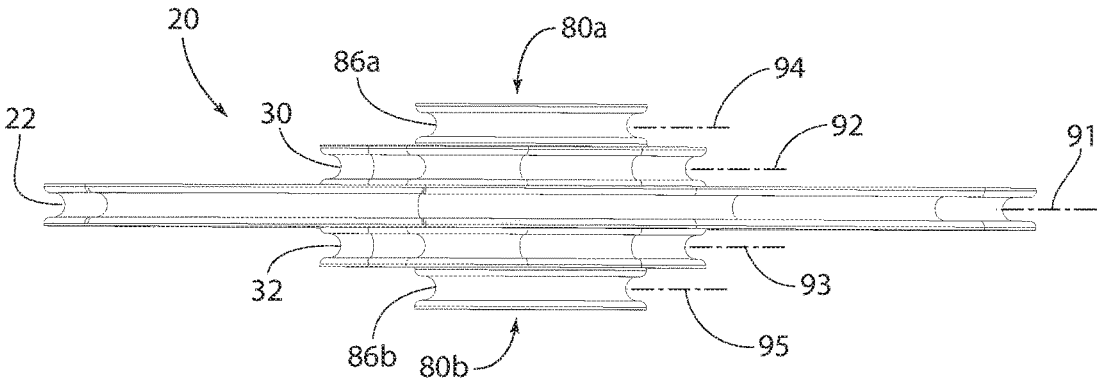
Figure 27:
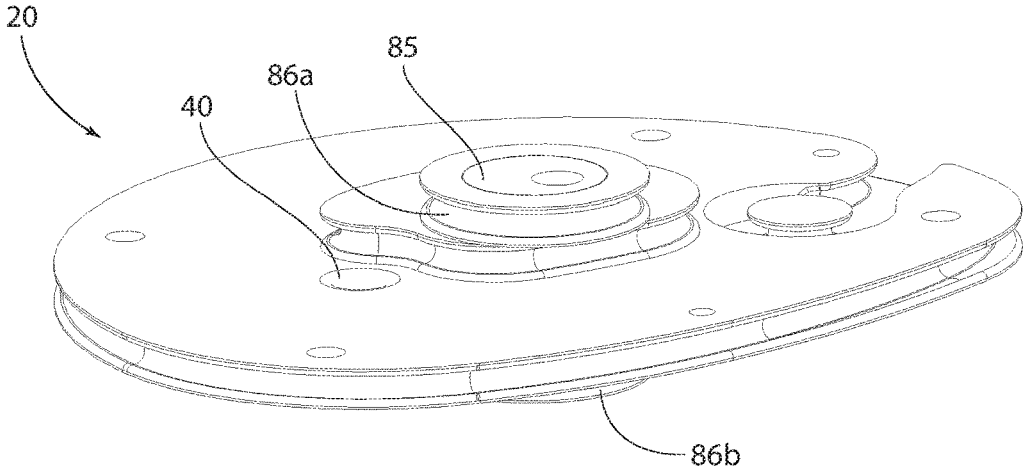

FIGS. 25-27 show another embodiment of a rotatable member 20. In some embodiments, a dynamic anchor 80 is arranged to move an effective anchor point of a power cable as the rotatable member rotates. In some embodiments, a dynamic anchor 80 is arranged to orbit the rotation axis 21. In some embodiments, a dynamic anchor 80 comprises a dynamic cable track 86 arranged to move with respect to other portions of the rotatable member 20. In some embodiments, a dynamic cable track 86 forms a closed ring, and the ring is rotatable with respect to the rotatable member 20. In some embodiments, a terminal loop of a power cable extends around the dynamic cable track 86 and the cable anchors to the dynamic cable track 86. In some embodiments, a centerpoint 87 of the dynamic cable track 86 is offset from the rotation axis 21. In some embodiments, a dynamic anchor 80 comprises a first portion 85 and a second portion 86, wherein the second portion 86 is movable with respect to the first portion 85. In some embodiments, the first portion 85 is fixed to rotatable member 20.

In some embodiments, a rotatable member 20 comprises a second dynamic anchor 80*b* comprising a dynamic cable track 86*b*.

In some embodiments, a bowstring track 22 is located in a first plane 91, the first cable track 30 is located in a second plane 92, the second cable track 32 is located in a third plane 93, the first dynamic cable track 86*a* is located in a fourth plane 94 and the second dynamic cable track 86*b* is located in a fifth plane 95. In some embodiments, the planes 91, 92, 93, 94, 95 are all parallel to one another.

Figure 28:
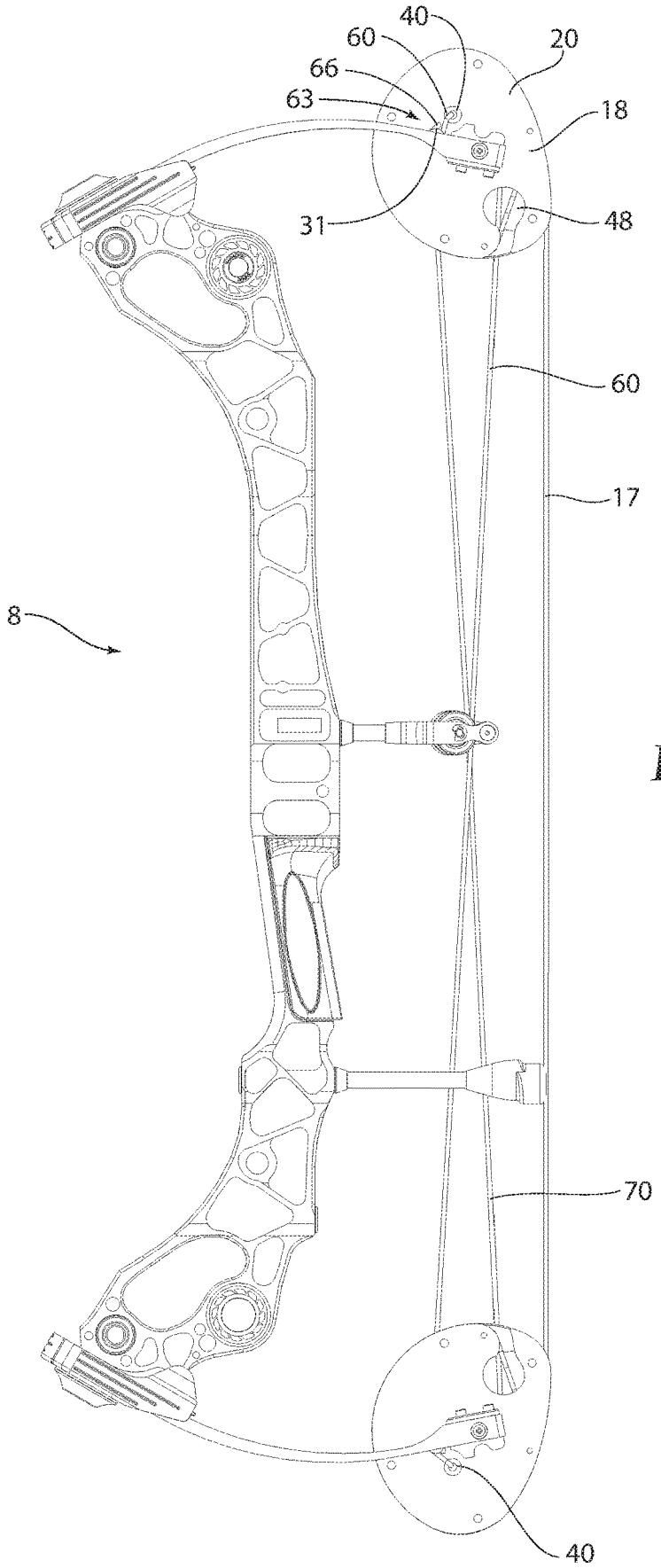
FIGS. 28-33 show an embodiment of an archery bow having an alternative cabling arrangement.
Figure 29:
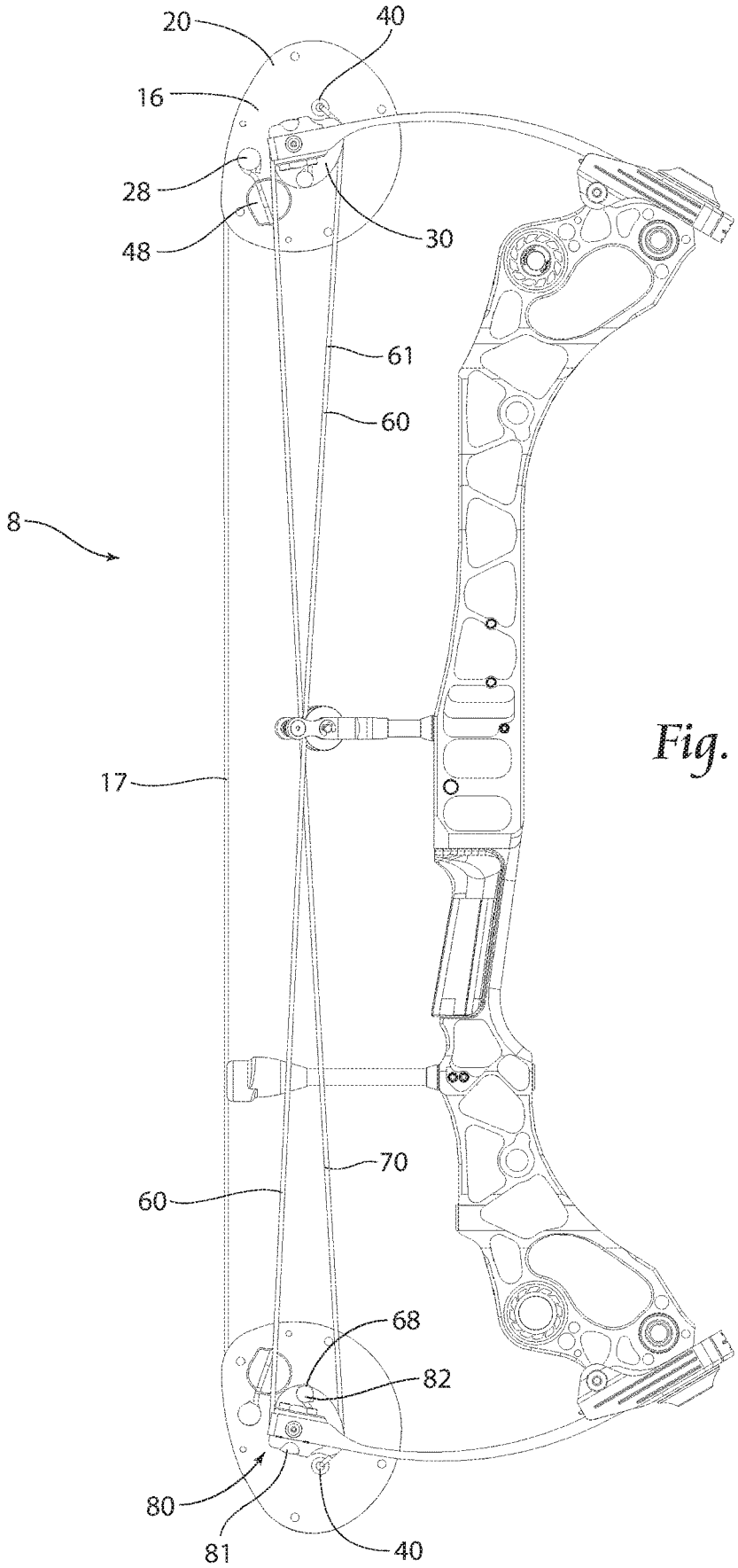
Figure 30:
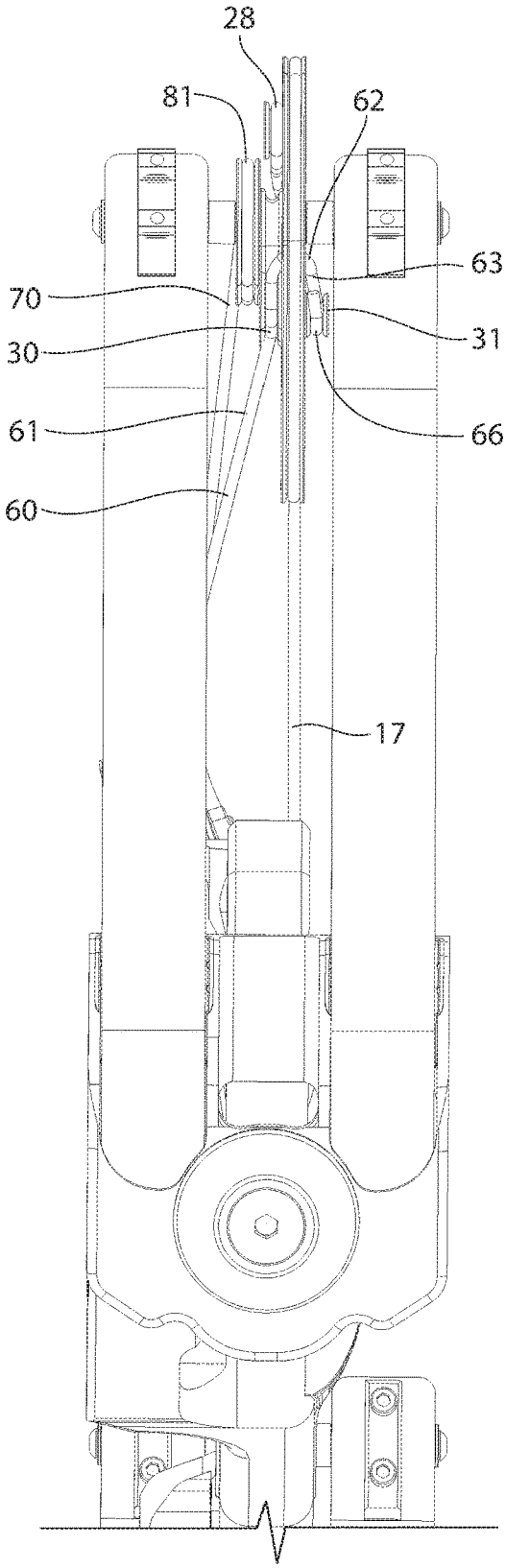
Figure 31:
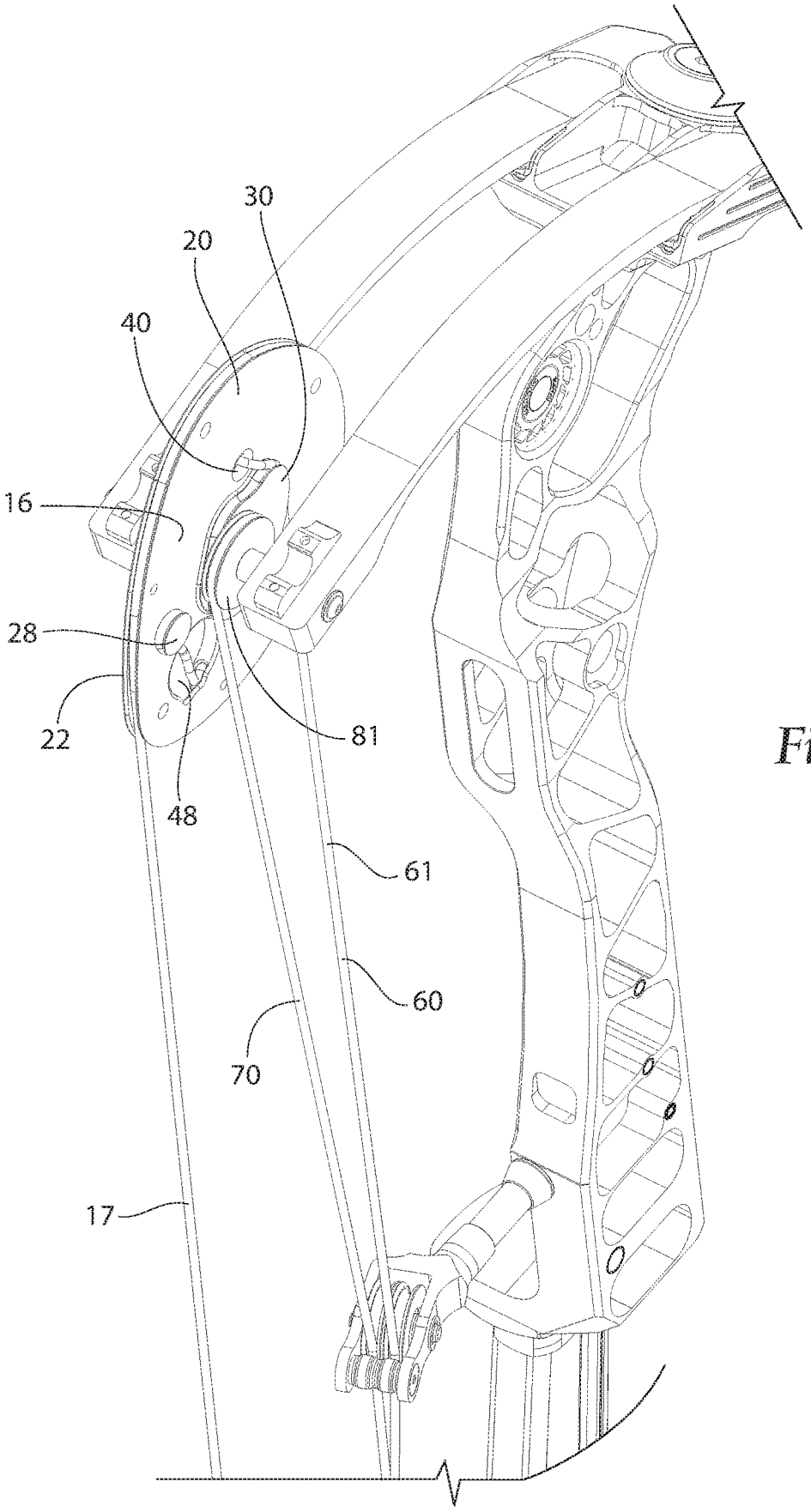
Figure 32:
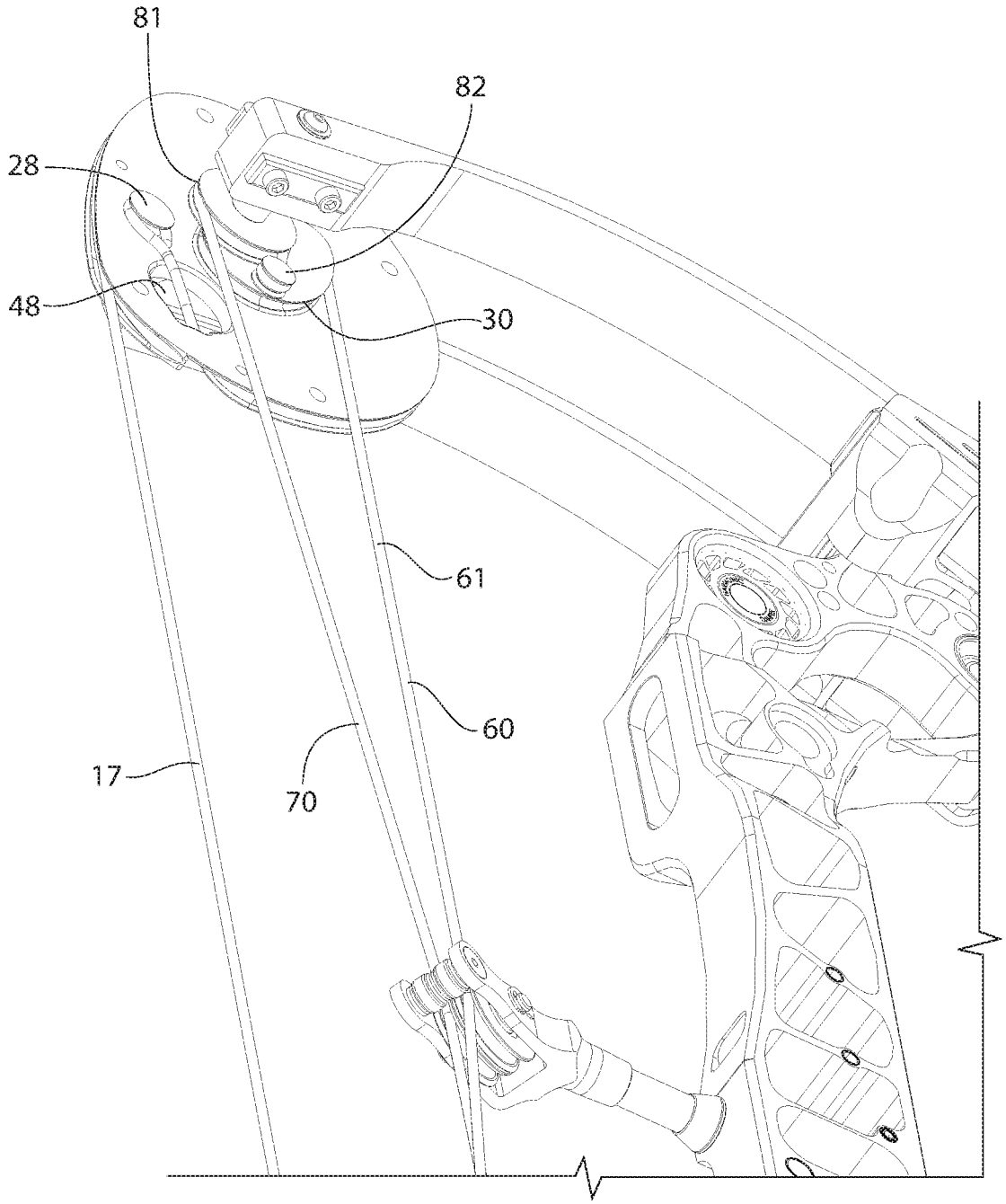
Figure 33:
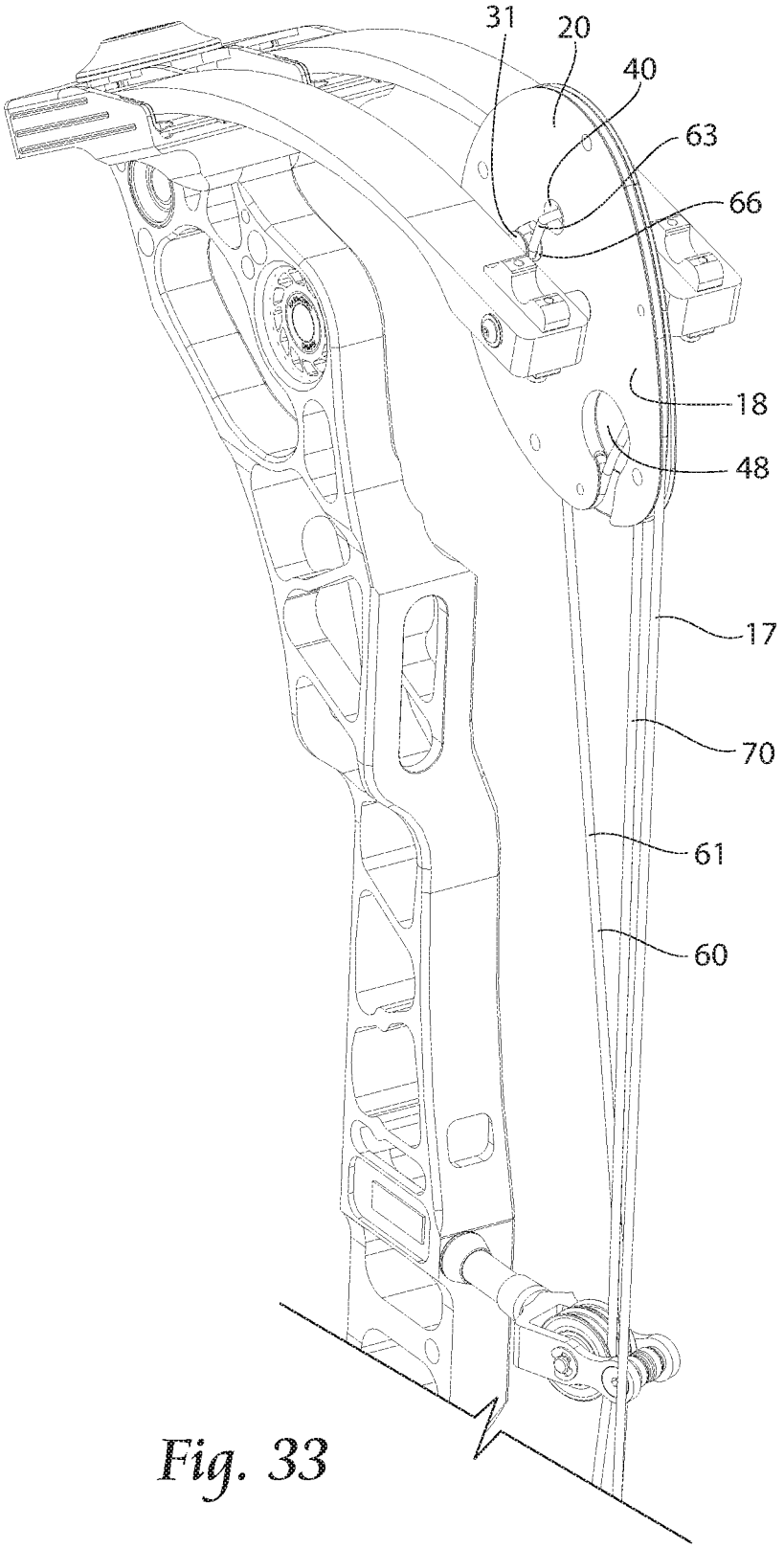
Figure 34:
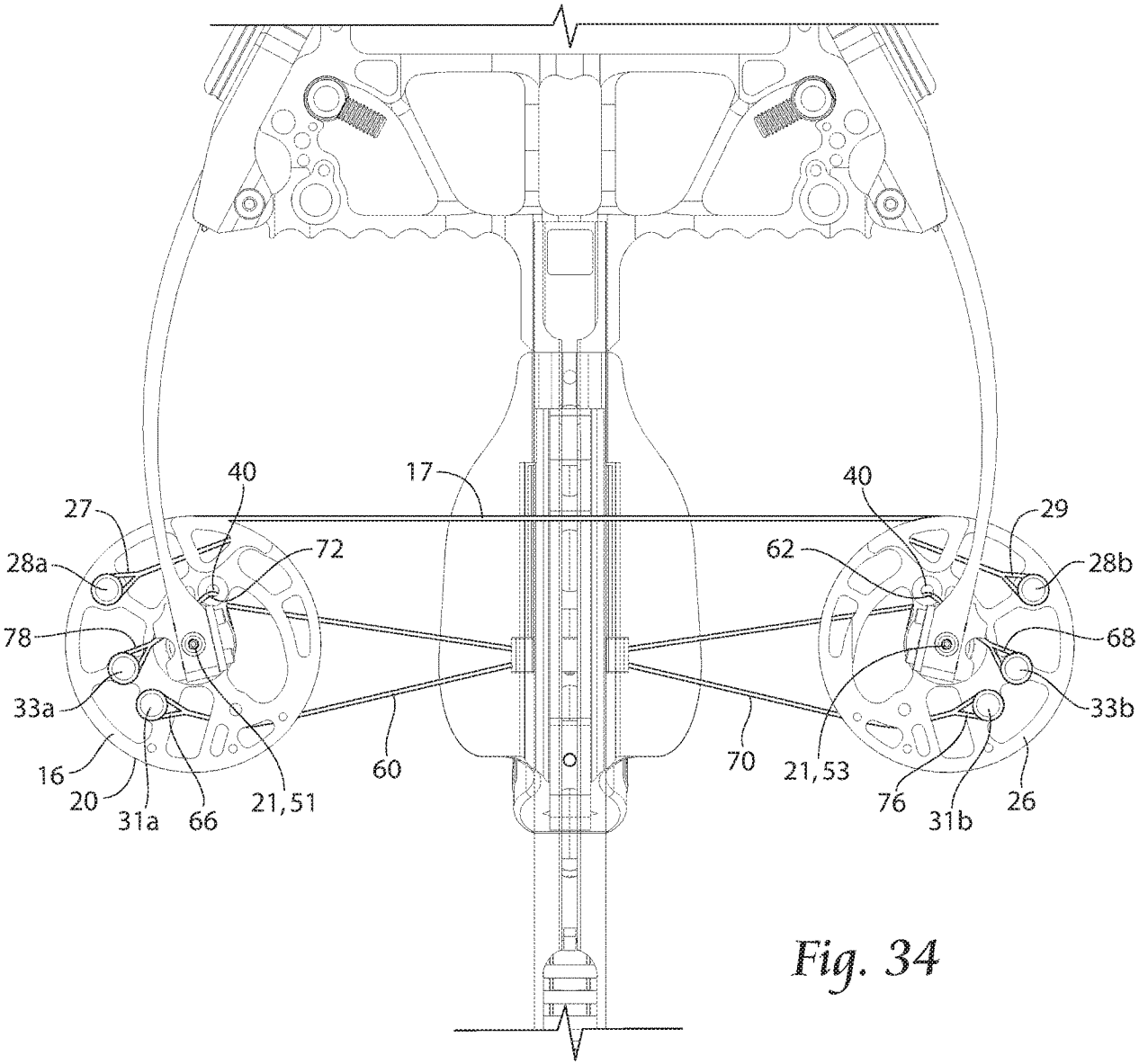
FIGS. 34-37 show an embodiment of an archery bow having an alternative cabling arrangement.
Figure 35:
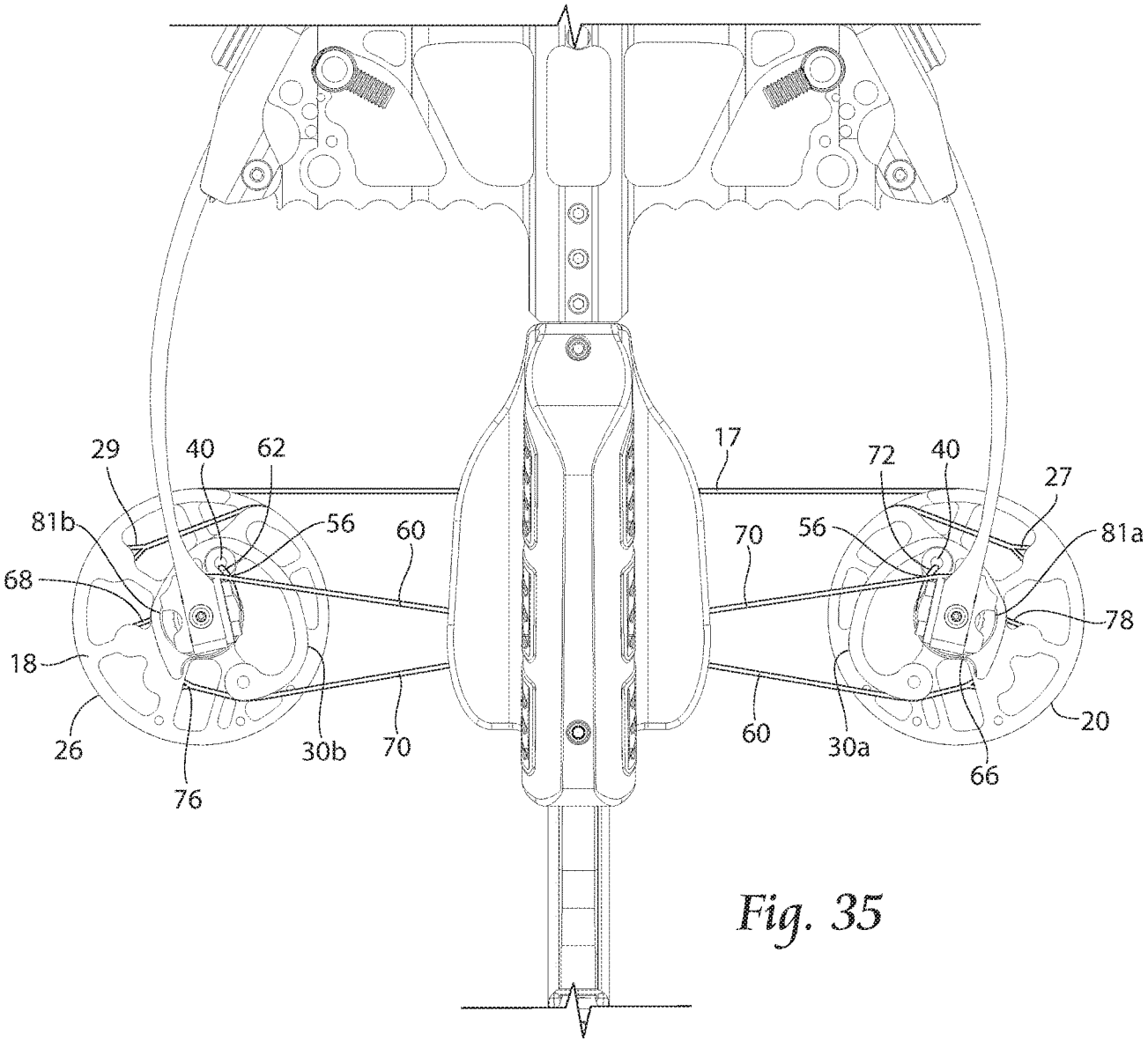
Figure 36:
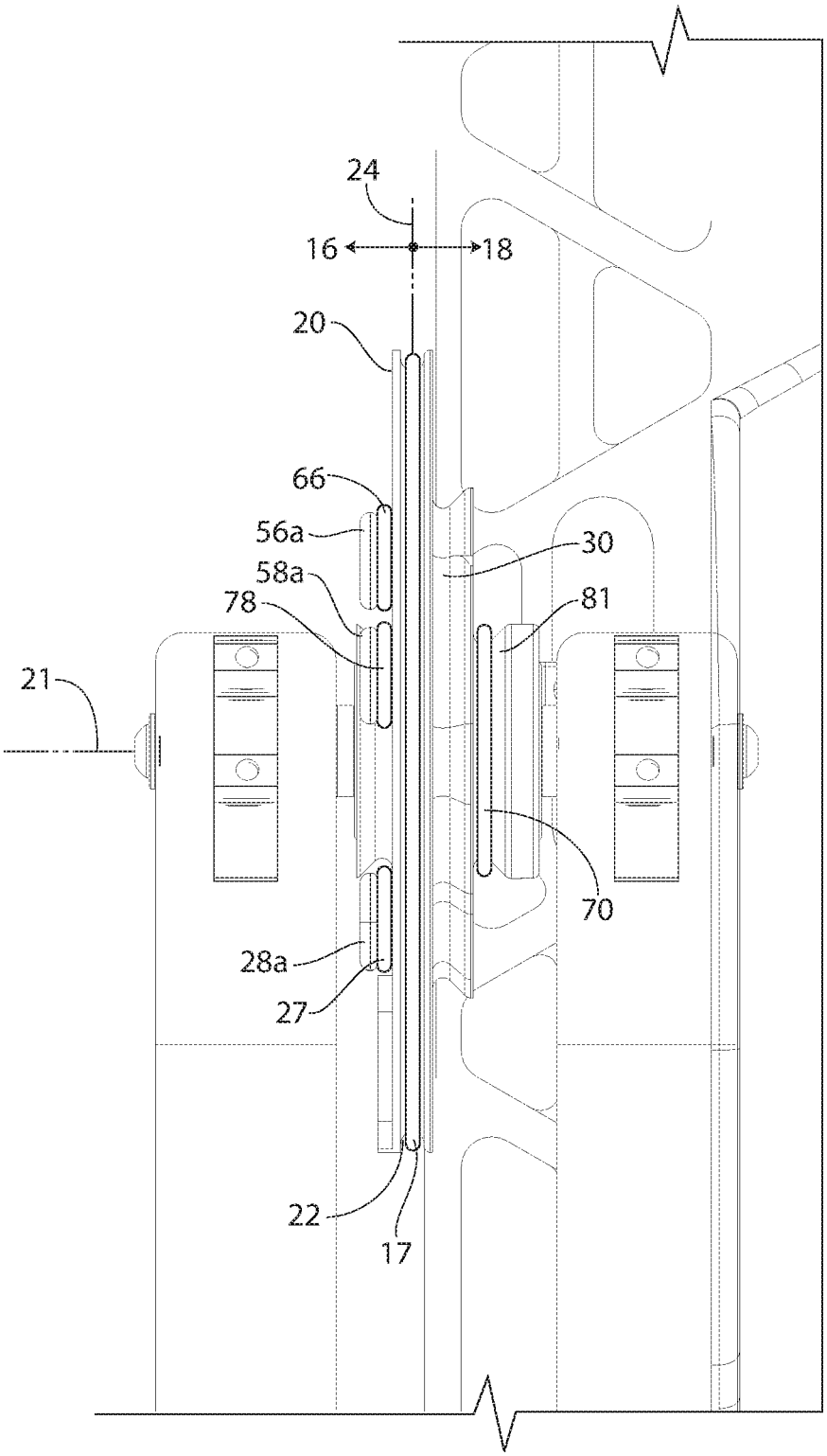
Figure 37:
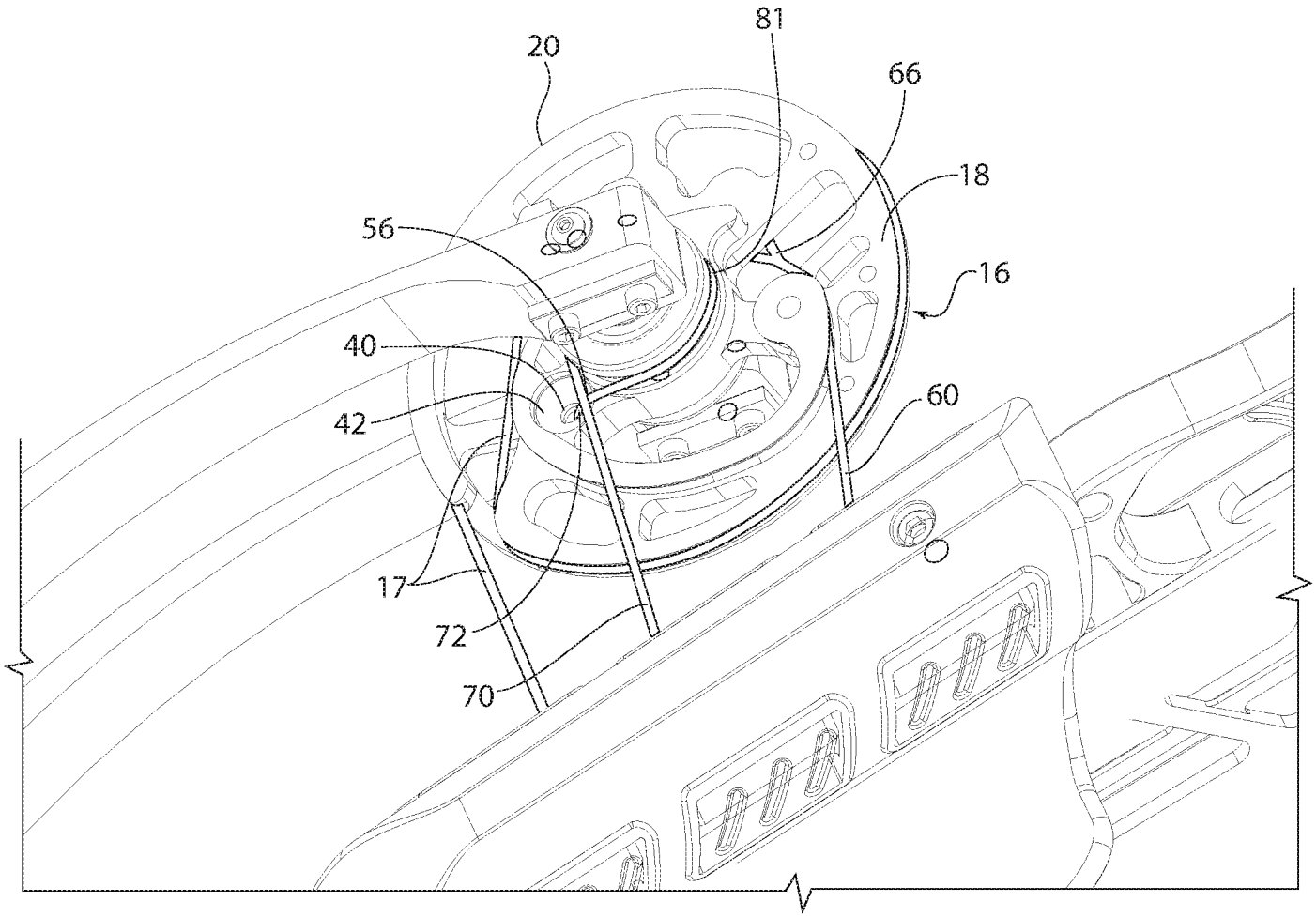

FIGS. 28 and 29 show an embodiment of an archery bow 8 having another cabling arrangement. FIGS. 30-33 show the first rotatable member 22 in greater detail.

In some embodiments, a power cable 60 comprises a first segment 61 oriented to a first side 16 of the rotatable member 20 and a second segment 63 located to a second side 18 of the rotatable member 20. In some embodiments, the first segment 61 is arranged to be taken up by a cable track 30. In some embodiments, the power cable 60 passes through a pass-through aperture 40 in the rotatable member, and the second segment attaches to a cable terminal post 31.

In some embodiments, the bowstring 17 is oriented in the bowstring track 22, passes through an aperture 48 in the rotatable member 20 and attaches to a terminal post 28. In some embodiments, the cable terminal post 31 and the bowstring terminal post 28 are oriented on opposite sides of the rotatable member 20. In some embodiments, the cable terminal post 31 is located on the second side 18 of the rotatable member 20, and the bowstring terminal post 28 is located on the first side 16.

In some embodiments, the power cable 60 extends toward the other rotatable member and attaches to an axle, to the other rotatable member, etc. As shown in FIGS. 28 and 29, a second end 68 of the power cable 60 is engaged with a dynamic anchor 80.

In some embodiments, the bow 8 comprises a second power cable 70 arranged in a configuration that is essentially mirrored with respect to the first power cable 60.

In some embodiments, a track formed in a rotatable member 20 extends through a pass-through aperture 40. In some embodiments, a track formed in a rotatable member 20 extends continuously and comprises the first cable track 30, passes through the pass-through aperture 40 and comprises the second cable track 32.

In some embodiments, a rotatable member comprises a pass-through aperture 40 and a lead-in track that leads into the pass-through aperture 40. In some embodiments, a lead-in track changes in depth, and in some embodiments, the depth increases in proximity to the pass-through aperture 40.

FIGS. 34-37 show different views of another embodiment of a bow 10. In some embodiments, a bow 10 comprises a first rotatable member 20 and a second rotatable member 26. In some embodiments, the first rotatable member 20 comprises a first terminal post 28*a*, a second terminal post 31*a* and a third terminal post 33*a*. In some embodiments, the three terminal posts 28*a*, 31*a*, 33*a* are located to a common side of the bowstring plane 24. In some embodiments, the three terminal posts 28*a*, 31*a*, 33*a* are located to a common side of the bowstring track 22. In some embodiments, the three terminal posts 28*a*, 31*a*, 33*a* are located on the first side 16 of the rotatable member 20.

In some embodiments, the second rotatable member 26 comprises a first terminal post 28*b*, a second terminal post 31*b* and a third terminal post 33*b*.

In some embodiments, the first terminal posts 28*a*, 28*b* comprise bowstring terminal posts 28*a*, 28*b*. In some embodiments, the bowstring 17 is attached at a first end 27 to the bowstring terminal post 28*a* of the first rotatable member 20 and is attached at a second end 29 to the bowstring terminal post 28*b* of the second rotatable member 26. In some embodiments, the first end 27 of the bowstring 17 is attached to the first side 16 of the first rotatable member 20 and the bowstring 17 extends around the bowstring track 22 of the first rotatable member 20. In some embodiments, the bowstring track 22 is oriented in the bowstring plane 24. Thus, in some embodiments, the bowstring 17 comprises a segment portion that is located in the bowstring plane 24 and a portion (e.g. end portion 27) that is located outside of the bowstring plane 24. In some embodiments, the bowstring 17 comprises a second end 29 that is located outside of the bowstring plane 24. In some embodiments, the second end 29 is attached to a first side 16 of the second rotatable member 26. In some embodiments, the second end 29 attaches to the bowstring terminal post 28*b* of the second rotatable member 26, and the bowstring terminal post 28*b* is located to the first side 16 of the second rotatable member 26.

In some embodiments, the bowstring 17 contacts a spoke of a rotatable member 20. In some embodiments, the spoke is located adjacent to the bowstring terminal post (e.g. 28*a*). In some embodiments, a surface of the spoke that contacts the bowstring 17 is located adjacent to the bowstring track 22, and the contacting surface of the spoke works to position the bowstring 17 in the bowstring plane 24.

In some embodiments, the first power cable 60 comprises a first end 66 and a second end 68. In some embodiments, the second power cable 70 comprises a first end 76 and a second end 78. In some embodiments, segments of the power cables 60, 70 located near the first ends 66, 76 are arranged to be taken up on respective cable tracks 30*a*, 30*b* of the rotatable members 20, 26 as the bow 10 is drawn. In some embodiments, the second ends 68, 78 of the power cables 60, 70 are attached to the third terminal posts 33*a*, 33*b* of the rotatable members 20, 26.

In some embodiments, the second terminal posts 31*a*, 31*b* are located to the first side 16 of the bowstring plane 24. In some embodiments, the third terminal posts 33*a*, 33*b* are located to the first side of the bowstring plane 24.

In some embodiments, the first end 66 of the first power cable 60 is attached to the first terminal post 31*a* of the first rotatable member 20. In some embodiments, the first terminal post 31*a* is located on the first side 16 of the first rotatable member 20. In some embodiments, the first power cable 60 passes through an opening in the first rotatable member 20, crosses the bowstring plane 24 and extends on the second side 18 of the first rotatable member 20. In some embodiments, the cable track 30*a* is located on the second side 18 of the bowstring plane 24, and a portion of the first power cable 60 is positioned in the cable track 30*a*. In some embodiments, the first power cable 60 extends to the second rotatable member 26 while positioned on the second side 18 of the bowstring plane 24. In some embodiments, the first power cable 60 passes through a crossbow stock. In some embodiments, the first power cable 60 engages the second rotatable member 26 on the second side 18 of the bowstring plane 24, passes through an aperture 40 in the second rotatable member 26. In some embodiments, the first power cable 60 crosses the bowstring plane 24, extends to the first side 16 of the second rotatable member 26, and the second end 68 attaches to the third terminal post 33*b* of the second rotatable member.

In some embodiments, the second rotatable member 26 comprises a cable anchoring track 81*b*, and a portion of the first power cable 60 is oriented in the cable anchoring track 81*b*. In some embodiments, the cable anchoring track 81*b* is located to the second side 18 of the bowstring plane 24. In some embodiments, the cable anchoring track 81*b* is arranged to feed out a portion of the first power cable 60 as the bow 10 is drawn.

In some embodiments, the first power cable 60 extends toward the second rotatable member 26, enters the cable anchoring track 81*b*, extends around the rotation axis 21 of the second rotatable member, crosses itself and passes through an aperture 40 in the second rotatable member 26. In some embodiments, the first power cable 60 crosses itself at a crossing point 56. In some embodiments, the first power cable 60 contacts itself at the crossing point 56. In some embodiments, the first power cable 60 extends from the crossing point 56 through an aperture 40 in the second rotatable member 26, crosses the bowstring plane 24 and attaches to the first side 16 of the second rotatable member.

In some embodiments, the first end 76 of the second power cable 70 is attached to the first terminal post 31*b* of the second rotatable member 26. In some embodiments, the first terminal post 31*b* is located on the first side 16 of the second rotatable member 26. In some embodiments, the second power cable 70 passes through an opening in the second rotatable member 26, crosses the bowstring plane 24 and extends on the second side 18 of the second rotatable member 26. In some embodiments, the cable track 30*b* is located on the second side 18 of the bowstring plane 24, and a portion of the second power cable 70 is positioned in the cable track 30*b*. In some embodiments, the second power cable 70 extends to the first rotatable member 20 while positioned on the second side 18 of the bowstring plane 24. In some embodiments, the second power cable 70 passes through a crossbow stock. In some embodiments, the second power cable 70 engages the first rotatable member 20 on the second side 18 of the bowstring plane 24, then passes through an aperture 40 in the first rotatable member 20. In some embodiments, the second power cable 70 crosses the bowstring plane 24, extends to the first side 16 of the first rotatable member 20, and the second end 78 attaches to the third terminal post 33*a* of the first rotatable member 20.

In some embodiments, the first rotatable member 20 comprises a cable anchoring track 81*a*, and a portion of the second power cable 70 is oriented in the cable anchoring track 81*a*. In some embodiments, the cable anchoring track 81*a* is located to the second side 18 of the bowstring plane 24. In some embodiments, the cable anchoring track 81*a* is arranged to feed out a portion of the second power cable 70 as the bow 10 is drawn.

In some embodiments, the second power cable 70 extends toward the first rotatable member 20, enters the cable anchoring track 81*a*, extends around the rotation axis 21 of the first rotatable member 20, crosses itself and passes through an aperture 40 in the first rotatable member 20. In some embodiments, the second power cable 70 crosses itself at a crossing point 56. In some embodiments, the second power cable 70 contacts itself at the crossing point 56. In some embodiments, the second power cable 70 extends from the crossing point 56 through an aperture 40 in the first rotatable member 20, crosses the bowstring plane 24 and attaches to the first side 16 of the first rotatable member 20.

In some embodiments, all terminal posts 28*a*, 31*a*, 33*a* of a rotatable member 20 are located to a first side 16 of the bowstring plane 24. In some embodiments, all cable tracks 30*a*, 81*a* of a rotatable member 20 are located to a second side 18 of the bowstring plane 24. In some embodiments, the bowstring track 22 of a rotatable member 20 is located in the bowstring plane 24.

In some embodiments, all terminal posts 28*a*, 31*a*, 33*a*, 28*b*, 31*b*, 33*b* of a bow 10 are located to a first side 16 of the bowstring plane 24. In some embodiments, all cable tracks 30*a*, 81*a*, 30*b*, 81*b* of a bow 10 are located to a second side 18 of the bowstring plane 24. In some embodiments, the bowstring tracks 22 of a bow 10 are located in the bowstring plane 24.

In some embodiments, a bowstring 17 comprises a plurality of strands of helically twisted material. In some embodiments, a power cable 60, 70 comprises a plurality of strands of helically twisted material. In some embodiments, the bowstring 17 comprises a greater number of strands of material than a power cable 60. In some embodiments, the bowstring comprises a fewer number of strands of material than a power cable 60.

In some embodiments, a bow comprises:

a first limb supporting a first rotatable member, the first rotatable member comprising a first terminal post, a second terminal post and a third terminal post;

a second limb supporting a second rotatable member, the second rotatable member comprising a fourth terminal post, a fifth terminal post and a sixth terminal post;

wherein all of said terminal posts are located to a common side of a bowstring plane.

In some embodiments, a bow comprises:

a first limb supporting a first rotatable member, the first rotatable member comprising a plurality of terminal posts;

a second limb supporting a second rotatable member, the second rotatable member comprising a plurality of terminal posts;

wherein all of said terminal posts are located to a common side of a bowstring plane.

The above disclosure is intended to be illustrative and not exhaustive. This description will suggest many variations and alternatives to one of ordinary skill in this field of art. All these alternatives and variations are intended to be included within the scope of the claims where the term "comprising" means "including, but not limited to." Those familiar with the art may recognize other equivalents to the specific embodiments described herein which equivalents are also intended to be encompassed by the claims.

Further, the particular features presented in the dependent claims can be combined with each other in other manners within the scope of the invention such that the invention should be recognized as also specifically directed to other embodiments having any other possible combination of the features of the dependent claims. For instance, for purposes of claim publication, any dependent claim which follows should be taken as alternatively written in a multiple dependent form from all prior claims which possess all antecedents referenced in such dependent claim if such multiple dependent format is an accepted format within the jurisdiction (e.g. each claim depending directly from claim 1 should be alternatively taken as depending from all previous claims). In jurisdictions where multiple dependent claim formats are restricted, the following dependent claims should each be also taken as alternatively written in each singly dependent claim format which creates a dependency from a prior antecedent-possessing claim other than the specific claim listed in such dependent claim below.

This completes the description of the preferred and alternate embodiments of the invention. Those skilled in the art may recognize other equivalents to the specific embodiment described herein which equivalents are intended to be encompassed by the claims attached hereto.

The invention claimed is:

1. A crossbow comprising:

a frame;

a first limb arranged to support a first rotatable member, said first rotatable member comprising a first side, a second side and a bowstring track, the first side comprising a first cable track and the second side comprising a second cable track;

a second limb arranged to support a second rotatable member;

a bowstring extending between the first rotatable member and the second rotatable member;

a stock attached to the frame;

a latch attached to the stock, the latch arranged to engage the bowstring;

a trigger arranged to release the latch;

a first cable segment engaged with the second limb and the first rotatable member, a second cable segment engaged with the second limb and the first rotatable member, the first cable segment oriented to the first side of the first rotatable member, the second cable segment oriented to the second side of the first rotatable member; and a biasing mechanism supported by the stock, the biasing mechanism biasing the first cable segment away from a shooting axis;

wherein the first cable track takes up the first cable segment and the second cable track takes up the second cable segment as the bowstring is drawn.

2. The crossbow of claim 1, wherein the first cable track is parallel to the second cable track.

3. The crossbow of claim 1, the biasing mechanism comprising a first biasing mechanism, the crossbow further comprising a second biasing mechanism biasing the second cable segment away from the shooting axis.

4. A crossbow comprising:

a stock;

a first limb arranged to support a first rotatable member, the first rotatable member comprising a first cable track and a second cable track;

a second limb arranged to support a second rotatable member, the second rotatable member comprising a third cable track and a fourth cable track;

a bowstring extending between the first rotatable member and the second rotatable member, the bowstring defining a bowstring plane;

a latch attached to the stock, the latch arranged to engage the bowstring;

a trigger arranged to release the latch;

a first cable segment engaged with the second limb and the first cable track, the first cable segment oriented above the bowstring plane;

a second cable segment engaged with the second limb and the second cable track, the second cable segment oriented below the bowstring plane;

a third cable segment engaged with the second limb and the third cable track, the third cable segment oriented above the bowstring plane;

a fourth cable segment engaged with the second limb and the fourth cable track, the fourth cable segment oriented below the bowstring plane; and a biasing mechanism supported by the stock, the biasing mechanism biasing the second cable segment away from a shooting axis.

5. The crossbow of claim 4, wherein the second cable segment is symmetrical with the first cable segment across the bowstring plane.

6. The crossbow of claim 4, the first rotatable member comprising a first side and a second side, the first side comprising the first cable track, the second side comprising the second cable track.

7. The crossbow of claim 6, wherein the first cable segment is taken up by the first cable track and the second cable segment is taken up by the second cable track when the bowstring is drawn.

8. The crossbow of claim 6, wherein the first cable track is symmetrical with the second cable track across the bowstring plane.

9. The crossbow of claim 4, wherein the third cable segment is symmetrical with the fourth cable segment across the bowstring plane.

10. The crossbow of claim 4, the second rotatable member comprising a first side and a second side, the first side comprising the third cable track, the second side comprising the fourth cable track.

11. The crossbow of claim 4, the first cable segment comprising an end loop engaged with a first cable post.

12. The crossbow of claim 11, the second cable segment comprising an end loop engaged with a second cable post.

13. The crossbow of claim 4, the biasing mechanism comprising a cable slider.

14. The crossbow of claim 4, the biasing mechanism comprising a first biasing mechanism, the crossbow further comprising a second biasing mechanism biasing the first cable segment away from the shooting axis.

* * * * *